US007707914B2

(12) United States Patent
Pietras et al.

(10) Patent No.: US 7,707,914 B2
(45) Date of Patent: May 4, 2010

(54) APPARATUS AND METHODS FOR CONNECTING TUBULARS

(75) Inventors: Bernd-Georg Pietras, Wedemark (DE); Martin Liess, Seeize (DE)

(73) Assignee: Weatherford/Lamb, Inc., Houston, TX (US)

( * ) Notice: Subject to any disclaimer, the term of this patent is extended or adjusted under 35 U.S.C. 154(b) by 202 days.

(21) Appl. No.: 10/850,354

(22) Filed: May 20, 2004

(65) Prior Publication Data

US 2005/0076744 A1 Apr. 14, 2005

Related U.S. Application Data

(63) Continuation-in-part of application No. 10/681,570, filed on Oct. 8, 2003, now abandoned.

(51) Int. Cl.
*B25B 17/00* (2006.01)
*B25B 13/25* (2006.01)

(52) U.S. Cl. ..... 81/57.16; 81/57.18; 81/57.19; 81/57.2; 81/57.21; 81/57.34

(58) Field of Classification Search ..... 81/57.15, 81/57.16, 57.17, 57.33, 57.34, 57.35, 57.19, 81/57.2, 57.18, 57.21
See application file for complete search history.

(56) References Cited

U.S. PATENT DOCUMENTS

| | | | | |
|---|---|---|---|---|
| 1,150,178 | A | 8/1915 | Diefendorf | |
| 1,386,908 | A | 8/1921 | Taylor | |
| 1,842,638 | A | 1/1932 | Wigle | |
| 2,214,194 | A | 9/1940 | Frankley | |
| 2,214,429 | A | 9/1940 | Miller | |
| 2,522,444 | A | 9/1950 | Grable | |
| 2,536,458 | A * | 1/1951 | Munsinger | 81/57.19 |
| 2,566,651 | A | 9/1951 | Bemis | |
| 2,610,690 | A | 9/1952 | Beatty | |
| 2,615,682 | A | 10/1952 | Stone | |
| 2,639,894 | A | 5/1953 | Smith | |
| 2,753,744 | A | 7/1956 | Therien | |
| 2,850,929 | A | 9/1958 | Crookston et al. | |

(Continued)

FOREIGN PATENT DOCUMENTS

| | | |
|---|---|---|
| DE | 2128362 | 1/1972 |

(Continued)

OTHER PUBLICATIONS

U.K. Search Report, Application No. GB0510174.6, dated Aug. 26, 2005.

*Primary Examiner*—Hadi Shakeri
(74) *Attorney, Agent, or Firm*—Patterson & Sheridan, LLP

(57) ABSTRACT

A method and apparatus for handling tubulars is provided. In one aspect, the present invention provides a spinner having a first arm having a first roller and a second arm having a second roller, the first arm and the second arm simultaneously adjustable to retain the tubular. The apparatus also includes a third roller capable of urging the tubular against the first and second rollers, wherein at least one of the first, second, and third rollers is actuatable to rotate the tubular. In one embodiment, the spinner further comprises a fluid operated cylinder for adjusting the first arm and the second arm. The arms are adjusted by actuating the cylinder extend or retract the first arm and the second arm.

23 Claims, 16 Drawing Sheets

U.S. PATENT DOCUMENTS

| | | | | | |
|---|---|---|---|---|---|
| 2,950,639 | A | | 8/1960 | Mason | |
| 3,021,739 | A | | 2/1962 | Grundmann | |
| 3,041,901 | A | | 7/1962 | Knights | |
| 3,086,413 | A | | 4/1963 | Mason | |
| 3,122,211 | A | * | 2/1964 | Wilson et al. | 81/57.35 |
| 3,122,811 | A | | 3/1964 | Gilreath | |
| 3,131,586 | A | | 5/1964 | Wilson | |
| 3,180,186 | A | | 4/1965 | Catland | |
| 3,220,245 | A | | 11/1965 | Van Winkle | |
| 3,302,496 | A | | 2/1967 | Mitchell et al. | |
| 3,349,455 | A | | 10/1967 | Doherty | |
| 3,392,609 | A | * | 7/1968 | Bartos | 81/57.19 |
| 3,443,291 | A | | 5/1969 | Doherty | |
| 3,475,038 | A | | 10/1969 | Matherne | |
| 3,518,903 | A | | 7/1970 | Ham et al. | |
| 3,559,739 | A | | 2/1971 | Hutchison | |
| 3,606,664 | A | | 9/1971 | Weiner | |
| 3,680,412 | A | | 8/1972 | Mayer et al. | |
| 3,722,331 | A | | 3/1973 | Radulescu | |
| 3,747,675 | A | | 7/1973 | Brown | |
| 3,796,418 | A | | 3/1974 | Carlberg | |
| 3,808,916 | A | | 5/1974 | Porter et al. | |
| 3,838,613 | A | | 10/1974 | Wilms | |
| 3,892,148 | A | | 7/1975 | Wiley | |
| 3,902,385 | A | | 9/1975 | Haby | |
| 3,906,820 | A | | 9/1975 | Hauk | |
| 3,919,902 | A | * | 11/1975 | Johnson | 81/57.16 |
| 3,933,108 | A | | 1/1976 | Baugh | |
| 3,941,348 | A | | 3/1976 | Mott | |
| 3,982,449 | A | * | 9/1976 | Choate, Jr. | 81/57.18 |
| 3,986,413 | A | | 10/1976 | Stockton | |
| 3,986,564 | A | | 10/1976 | Bender | |
| 4,005,621 | A | | 2/1977 | Turner, Jr. et al. | |
| 4,023,449 | A | | 5/1977 | Boyadjieff | |
| 4,092,881 | A | * | 6/1978 | Jurgens et al. | 81/57.34 |
| 4,142,739 | A | | 3/1979 | Billingsley | |
| 4,159,637 | A | | 7/1979 | Lamb et al. | |
| 4,170,908 | A | | 10/1979 | Peveto et al. | |
| 4,200,010 | A | | 4/1980 | Hewitt | |
| 4,202,225 | A | | 5/1980 | Sheldon et al. | |
| 4,212,212 | A | | 7/1980 | Chandler et al. | |
| 4,215,602 | A | | 8/1980 | Carstensen et al. | |
| 4,221,269 | A | | 9/1980 | Hudson | |
| 4,246,809 | A | | 1/1981 | Keast et al. | |
| 4,257,442 | A | | 3/1981 | Claycomb | |
| 4,262,693 | A | | 4/1981 | Giebeler | |
| 4,280,380 | A | | 7/1981 | Eshghy | |
| 4,291,762 | A | | 9/1981 | Gudgel | |
| 4,295,527 | A | | 10/1981 | Russe | |
| 4,315,553 | A | | 2/1982 | Stallings | |
| 4,334,444 | A | | 6/1982 | Carstensen et al. | |
| 4,336,629 | A | | 6/1982 | Jarvis, Jr. et al. | |
| 4,348,920 | A | | 9/1982 | Boyadjieff | |
| 4,401,000 | A | | 8/1983 | Kinzbach | |
| 4,402,239 | A | | 9/1983 | Mooney | |
| 4,403,666 | A | | 9/1983 | Willis | |
| 4,425,827 | A | | 1/1984 | Wells | |
| 4,442,892 | A | | 4/1984 | Delesandri | |
| 4,446,761 | A | | 5/1984 | Boyadjieff et al. | |
| RE31,699 | E | | 10/1984 | Eckel | |
| 4,478,111 | A | | 10/1984 | Wells et al. | |
| 4,492,134 | A | | 1/1985 | Reinholdt et al. | |
| 4,497,224 | A | | 2/1985 | Jurgens | |
| 4,499,919 | A | | 2/1985 | Forester | |
| 4,512,216 | A | | 4/1985 | Callegari, Sr. et al. | |
| 4,565,003 | A | | 1/1986 | McLeod | |
| 4,572,036 | A | | 2/1986 | Renfro | |
| 4,573,359 | A | | 3/1986 | Carstensen | |
| 4,592,125 | A | | 6/1986 | Skene | |
| 4,593,773 | A | | 6/1986 | Skeie | |
| 4,643,259 | A | | 2/1987 | Zeringue, Jr. | |
| 4,648,292 | A | | 3/1987 | Haynes et al. | |
| 4,649,777 | A | | 3/1987 | Buck | |
| 4,709,766 | A | | 12/1987 | Boyadjieff | |
| 4,712,284 | A | | 12/1987 | Coyle, Sr. et al. | |
| 4,715,625 | A | | 12/1987 | Shows, Jr. et al. | |
| 4,732,373 | A | | 3/1988 | Yang | |
| 4,738,145 | A | | 4/1988 | Vincent et al. | |
| 4,773,218 | A | | 9/1988 | Wakita et al. | |
| 4,774,861 | A | | 10/1988 | Hamilton et al. | |
| 4,811,635 | A | | 3/1989 | Falgout, Sr. | |
| 4,821,814 | A | | 4/1989 | Willis et al. | |
| 4,843,924 | A | | 7/1989 | Hauk | |
| 4,869,137 | A | | 9/1989 | Slator | |
| 4,895,056 | A | | 1/1990 | Schulze-Beckinghausen | |
| 4,938,109 | A | | 7/1990 | Torres et al. | |
| 4,969,638 | A | | 11/1990 | Yang | |
| 4,979,356 | A | | 12/1990 | Vatne | |
| 5,000,065 | A | | 3/1991 | Haynes | |
| 5,022,472 | A | | 6/1991 | Bailey et al. | |
| 5,044,232 | A | | 9/1991 | Schulze-Beckinghausen | |
| 5,054,550 | A | | 10/1991 | Hodge | |
| 5,092,399 | A | | 3/1992 | Lang | |
| RE34,063 | E | | 9/1992 | Vincent et al. | |
| 5,150,642 | A | | 9/1992 | Moody et al. | |
| 5,159,860 | A | | 11/1992 | Pietras | |
| 5,161,438 | A | | 11/1992 | Pietras | |
| 5,167,173 | A | | 12/1992 | Pietras | |
| 5,172,613 | A | | 12/1992 | Wesch, Jr. | |
| 5,209,302 | A | | 5/1993 | Robichaux et al. | |
| 5,221,099 | A | | 6/1993 | Jansch | |
| 5,259,275 | A | | 11/1993 | Schulze-Beckinghausen | |
| 5,297,833 | A | | 3/1994 | Willis et al. | |
| 5,351,582 | A | | 10/1994 | Snyder et al. | |
| 5,390,568 | A | | 2/1995 | Pietras | |
| 5,451,084 | A | | 9/1995 | Jansch | |
| 5,520,072 | A | | 5/1996 | Perry | |
| 5,537,900 | A | | 7/1996 | Schaar | |
| 5,634,671 | A | | 6/1997 | Vatkins | |
| 5,660,087 | A | | 8/1997 | Rae | |
| 5,667,026 | A | | 9/1997 | Lorenz et al. | |
| 5,706,893 | A | | 1/1998 | Morgan | |
| 5,730,471 | A | | 3/1998 | Schulze-Beckinghausen et al. | |
| 5,746,276 | A | | 5/1998 | Stuart | |
| 5,787,982 | A | | 8/1998 | Bakke | |
| 5,819,605 | A | | 10/1998 | Buck et al. | |
| 5,823,074 | A | | 10/1998 | Ahlstone | |
| 5,839,330 | A | | 11/1998 | Stokka | |
| 5,842,390 | A | | 12/1998 | Bouligny et al. | |
| 5,845,549 | A | | 12/1998 | Bouligny | |
| 5,868,045 | A | | 2/1999 | Huak | |
| 5,890,549 | A | | 4/1999 | Sprehe | |
| 5,992,801 | A | | 11/1999 | Torres | |
| 5,996,444 | A | | 12/1999 | Pearce et al. | |
| 6,047,775 | A | | 4/2000 | Mock | |
| 6,065,372 | A | | 5/2000 | Rauch | |
| 6,082,224 | A | | 7/2000 | McDaniels et al. | |
| 6,082,225 | A | | 7/2000 | Richardson | |
| 6,116,118 | A | | 9/2000 | Wesch, Jr. | |
| 6,119,772 | A | | 9/2000 | Pruet | |
| 6,138,529 | A | | 10/2000 | Pietras | |
| 6,142,041 | A | | 11/2000 | Buck | |
| 6,161,617 | A | | 12/2000 | Gjedebo | |
| 6,206,096 | B1 | | 3/2001 | Belik | |
| 6,223,629 | B1 | | 5/2001 | Bangert | |
| 6,237,445 | B1 | | 5/2001 | Wesch, Jr. | |
| 6,253,845 | B1 | | 7/2001 | Belik | |
| 6,276,238 | B1 | | 8/2001 | Junck et al. | |
| 6,305,720 | B1 | | 10/2001 | Spiering et al. | |
| 6,315,051 | B1 | | 11/2001 | Ayling | |
| 6,327,938 | B1 | | 12/2001 | Pietras | |
| 6,330,911 | B1 | | 12/2001 | Allen et al. | |
| 6,334,376 | B1 | | 1/2002 | Torres | |
| 6,360,633 | B2 | | 3/2002 | Pietras | |

| | | | | |
|---|---|---|---|---|
| 6,374,706 | B1 | 4/2002 | Newman | |
| 6,412,554 | B1 | 7/2002 | Allen et al. | |
| 6,480,811 | B2 | 11/2002 | Denny et al. | |
| 6,619,389 | B1 | 9/2003 | Kidd et al. | |
| 6,722,231 | B2 | 4/2004 | Hauk et al. | |
| 6,776,070 | B1 * | 8/2004 | Mason et al. | 81/57.35 |
| 6,814,149 | B2 | 11/2004 | Liess et al. | |
| 6,910,402 | B2 | 6/2005 | Drzewiecki | |
| 6,935,210 | B2 | 8/2005 | Hauk et al. | |
| 7,036,396 | B2 * | 5/2006 | Moe et al. | 81/57.2 |
| 7,055,594 | B1 | 6/2006 | Springett et al. | |
| 7,076,852 | B2 | 7/2006 | Penman et al. | |
| 7,370,707 | B2 * | 5/2008 | McDaniel et al. | 166/380 |
| 2002/0157823 | A1 | 10/2002 | Pietras et al. | |
| 2003/0075023 | A1 | 4/2003 | Robichaux | |
| 2004/0237726 | A1 | 12/2004 | Schulze Beckinghuasen | |

FOREIGN PATENT DOCUMENTS

| | | |
|---|---|---|
| EP | 0 087 373 | 8/1983 |
| EP | 0 285 386 | 3/1988 |
| EP | 0 311 455 | 4/1989 |
| EP | 0 339 005 | 10/1989 |
| EP | 0 525 247 | 2/1993 |
| GB | 804798 | 11/1958 |
| GB | 898572 | 6/1962 |
| GB | 1 215 967 | 12/1970 |
| GB | 2 049 518 | 12/1980 |
| GB | 2 128 526 | 9/1982 |
| GB | 2 115 940 | 9/1983 |
| GB | 2 300 896 | 11/1996 |
| GB | 2 346 576 | 8/2000 |
| GB | 2 346 577 | 8/2000 |
| GB | 2 352 667 | 2/2001 |
| WO | WO 83/03443 | 10/1983 |
| WO | WO 92/18744 | 10/1992 |
| WO | WO 93/18276 | 9/1993 |
| WO | WO 95/20471 | 8/1995 |
| WO | WO 98/16716 | 4/1998 |
| WO | WO 98/32948 | 7/1998 |
| WO | WO 99/34089 | 7/1999 |
| WO | WO 99/34090 | 7/1999 |
| WO | WO 99/34091 | 7/1999 |
| WO | WO 00/22278 | 4/2000 |
| WO | WO 00/23686 | 4/2000 |
| WO | WO 00/45026 | 8/2000 |
| WO | WO 00/61906 | 10/2000 |
| WO | WO 00/74899 | 12/2000 |
| WO | WO 00/79092 | 12/2000 |
| WO | WO 01/03889 | 1/2001 |
| WO | WO 01/09479 | 2/2001 |
| WO | WO 01/38688 | 5/2001 |
| WO | WO 01/66905 | 9/2001 |
| WO | WO 01/81047 | 11/2001 |

* cited by examiner

APPARATUS AND METHODS FOR CONNECTING TUBULARS

CROSS-REFERENCE TO RELATED APPLICATIONS

This application is a continuation-in-part of U.S. patent application Ser. No. 10/681,570, filed Oct. 8, 2003, now abandoned which application is herein incorporated by reference in its entirety.

BACKGROUND OF THE INVENTION

1. Field of the Invention

The present invention generally relates to apparatus and methods for making or breaking tubular connections. Particularly, the present invention relates to an apparatus for rotating one tubular relative to another tubular. More particularly, the present invention relates a spinner for rotating a tubular at a high rate of speed during make up/break out of a tubular connection.

2. Description of the Related Art

In the construction of oil or gas wells it is usually necessary to construct long drill pipes. Due to the length of these pipes, sections of pipe are progressively added to the pipe string as it is lowered into the well from a drilling platform. In particular, when it is desired to add a section of pipe, the pipe string is initially restrained from falling into the well by applying the slips of a spider located in the floor of the drilling platform. The new section of pipe is then moved from a rack to the well center above the spider. The threaded pin of the section of pipe to be connected is then located over the threaded box of the pipe string in the well and the connection is made up by rotation therebetween. Thereafter, the newly extended pipe string is released from the spider. The whole pipe string is then lowered until the top of the pipe section is adjacent the spider whereupon the slips of the spider are re-applied to maintain the pipe string in the wellbore.

It is common practice to use a tong assembly to apply a predetermined torque to make up the connection. The tong assembly is typically located on the platform, either on rails, or hung from a derrick on a chain. In order to make up or break out a threaded connection, the tong assembly has a two tong arrangement. An active (or wrenching) tong supplies torque to the section of pipe above the threaded connection, while a passive (or back up) tong supplies a reaction torque below the threaded connection. Particularly, the back up tong clamps the pipe string below the threaded connection, and prevents it from rotating. The clamping of the pipe string may be performed mechanically, hydraulically, or pneumatically. The wrenching tong clamps the upper part of the connection and is driven so that it supplies torque for a limited angle to rotate the section of pipe relative to the pipe string.

This power tong arrangement may also be used to make up connections between other types of wellbore tubulars, for example, casing and tubing.

In order to make up or break out a drill pipe connection, high torque must be supplied over a large angle. This angle is sometimes six times higher than a conventional wrenching tong can supply. In order to overcome this, the wrenching tong must grip and wrench the pipe section repeatedly to fully tighten or break the threaded connection. Due to the high costs associated with the construction of oil and gas wells, time is critical, and the repeated clamping and unclamping of the wrenching tong increases the time needed to attach each new section of tubular.

Spinners have been used in combination with the power tong assembly to facilitate the tubular connection process. Spinners are typically designed to rapidly rotate the pipe section. Spinners generally include rollers for engaging the pipe section about its periphery. The rollers are rotated to spin the pipe section relative to the pipe string to make up the connection.

The ongoing challenge to reduce operational time necessitates a spinner that is capable of handling a wide range of tubular sizes. Because oil rigs have limited space, it would be desirable to have one spinner for handling the different sized tubulars encountered on a rig. Another benefit of using only one spinner is that time required to adjust the spinner, such as changing the size of the rollers, is eliminated.

There is a need, therefore, for an improved apparatus for making or breaking a tubular connection. There is also a need for an apparatus that will reduce the time it takes to make up or break out a tubular connection. There is a further need to quickly adjust to the size of the tubular to be handled. There is also a need for an apparatus capable of working in combination with a tong assembly to make up or break out a tubular connection.

SUMMARY OF THE INVENTION

The present invention provides apparatus and methods for connecting tubulars. In one aspect, the present invention provides a spinner having a first arm having a first roller and a second arm having a second roller, the first arm and the second arm simultaneously adjustable to retain the tubular. The apparatus also includes a third roller capable of urging the tubular against the first and second rollers, wherein at least one of the first, second, and third rollers is actuatable to rotate the tubular.

In one embodiment, the spinner further comprises a fluid operated cylinder for adjusting the first arm and the second arm. The arms are adjusted by actuating the cylinder extend or retract the first arm and the second arm. In another embodiment, the first arm and the second arm are coupled together and may retract or extend simultaneously. In another embodiment still, the arms may include a cam surface to move the rollers closer together to adjust to the size of the tubular being retained. In another embodiment still, at least one of the rollers is equipped with a motor to supply torque to the tubular.

In another aspect, the present invention provides a method of rotating a tubular. The method includes providing a tubular rotating apparatus having a first arm equipped with a first roller and a second arm equipped with a second roller. The method also includes engaging the tubular with the first roller and the second roller, actuating the first arm and the second arm to move a third roller into engagement with the tubular, and rotating at least one of the first roller, second roller, and the third roller, thereby rotating the tubular.

In one embodiment, the method also includes actuating the third roller to apply a gripping force against the tubular. A cylinder may be actuated to apply the gripping force. The third roller may also be actuated to transfer torque to the tubular.

In another aspect, the spinner is used in combination with the tong assembly to make up or break up a tubular connection. Initially, the spinner is used to rotate a first tubular relative to a second tubular. Preferably, the first tubular is rotated using low torque. Thereafter, the tong assembly is used to complete the tubular connection by supplying high torque.

In another aspect, the spinner may be equipped with a stabbing guide.

In another aspect, the present invention provides an apparatus for connecting a first tubular with a second tubular. The apparatus comprises a tubular handling member having a plurality of rollers, wherein the plurality of rollers are adjustable to retain the first tubular. The apparatus also includes a guide member disposed below each of the plurality of rollers, wherein adjusting the plurality of rollers also adjusts the guide member such that the guide member is capable of surrounding the second tubular, whereby the guide member can guide the first tubular into engagement with the second tubular. In one embodiment, a contact surface of the guide member is flush with a contact surface of the plurality of rollers. In another embodiment, the apparatus further comprises a biasing member adapted to reduce a contact force between the guide member and the second tubular.

In another aspect, the present invention provides a method of connecting a first tubular with a second tubular. The method comprises providing a tubular rotating apparatus having a plurality of rollers and attaching a guide member below each of the plurality of rollers. The method also includes engaging the rollers with the first tubular, positioning the guide member around the second tubular, and guiding the first tubular into engagement with second tubular. Thereafter, the first tubular is rotated, thereby connecting the first tubular with the second tubular. In one embodiment, engaging the rollers with the first tubular also positions the guide member around the second tubular.

In another aspect, the apparatus includes a first tong for engaging a first tubular and a second tong for engaging a second tubular. Preferably, the tongs are mounted on a movable frame for moving the tongs to and from the tubulars. In one embodiment, the apparatus includes a torque member for rotating the first tong. In this manner, the first tubular may be rotated relative to the second tubular to makeup or breakout the tubulars.

In another aspect, the present invention provides a gripping apparatus for handling a tubular. The gripping apparatus is adapted to quickly adjust to the size of the tubular to be handled. The gripping apparatus comprises a first gripping member operatively coupled to a second gripping member to retain the tubular. Each of the gripping members has a jaw for contacting the tubular. In one embodiment, at least one of the jaws is actuatable to apply a gripping force to the tubular.

In another aspect, the gripping apparatus includes an actuator to cause the first and second gripping members to engage the tubular. In one embodiment, the actuator comprises a spindle. The first gripping member is operatively coupled to the spindle using a nut. Rotation of the spindle causes the nut to move along the threads of the spindle, thereby moving the first gripping member relative to the second gripping member. In another embodiment, the actuator comprises a piston and cylinder assembly.

In another aspect, the gripping apparatus includes features adapted to resist elastic deformation. In one embodiment, the loading bearing components are provided with spherical bearings or cylindrical bearings. In another embodiment, one or more force distributors are used to distribute torque acting on the gripping members to the housing of the gripping apparatus.

The presenting invention also provides a method for handling a tubular. The method includes providing a first gripping member having a first jaw and a second gripping member having a second jaw. The gripping members are actuated to engage the tubular. Thereafter, the second jaw is actuated to apply a gripping pressure.

In another aspect still, the present invention provides a method for connecting a first tubular to a second tubular. The method includes providing a first tong and a second tong, the first tong rotatable relative to the second tong. Initially, the second tong is caused to engage the second tubular. The first tong is rotated relative to the second tong into position to engage the first tubular. After the first tong engages the first tubular, the first tong is rotated to connect the tubulars.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention relates to a tong assembly for making up and breaking out a tubular connection. The tong assembly includes a power tong and a backup tong to apply torque the tubular connection. Each tong includes a powered gripping arrangement to apply a gripping force to the tubular.

Figure 1:
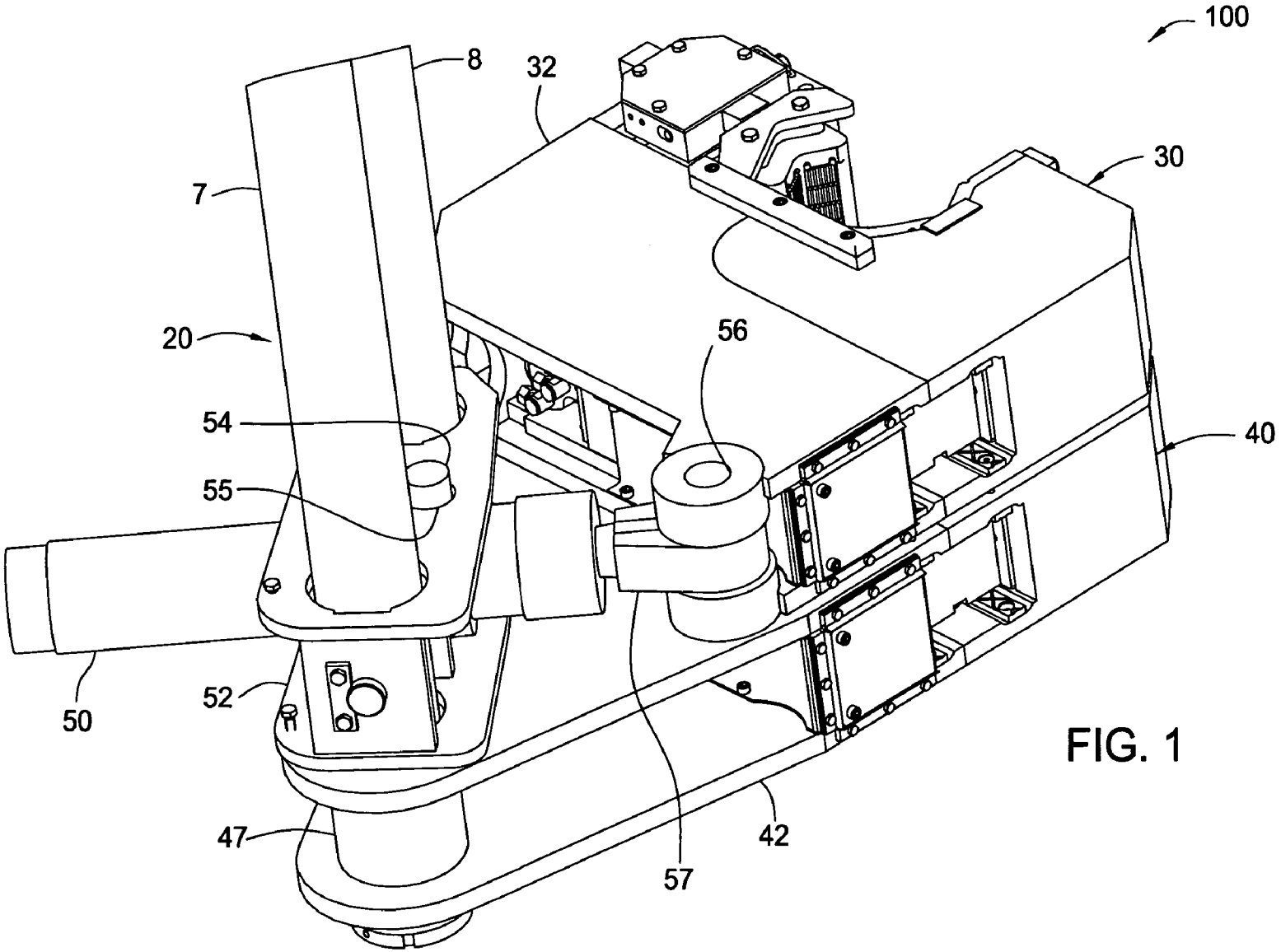
FIG. 1 illustrates an embodiment of the tong assembly according to aspects of the present invention. The tong assembly is shown the unactuated position.

FIG. 1 illustrates an embodiment of the tong assembly 100 according to aspects of the present invention. The tong assembly 100 is held above the wellbore by a movable frame 20. The frame 20 includes a pair of columns 7, 8 for attachment to the tong assembly 100. The movable frame 20 may include moving mechanisms such as wheels, rails, cables, or combinations thereof. The movable frame 20 may be used to move the tong assembly 100 to and from the tubulars.

Figure 2:
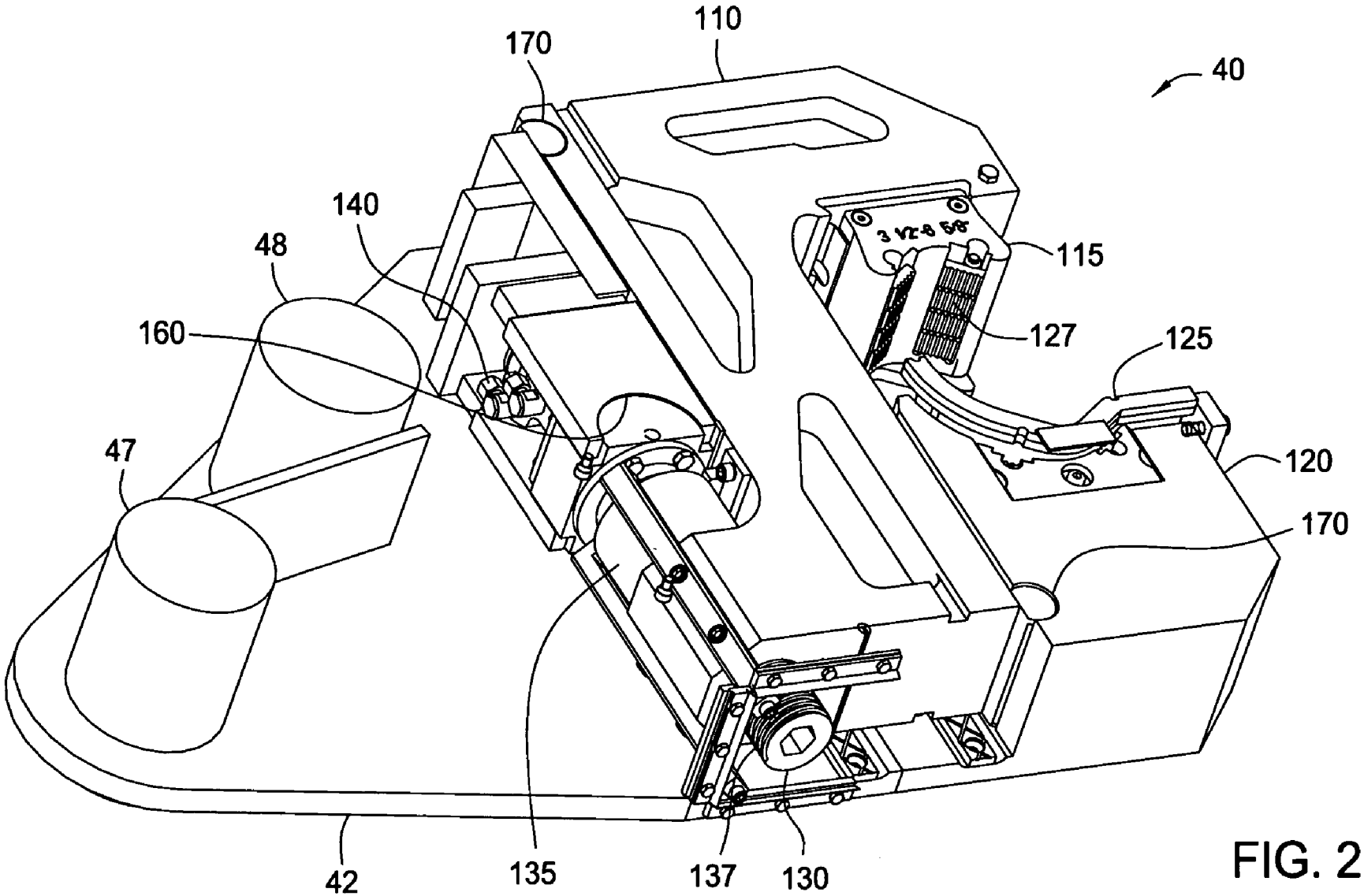
FIG. 2 shows the backup tong with a portion of its housing removed for clarity.

In one aspect, the tong assembly 100 includes a wrenching tong 30 and a backup tong 40. As shown, the frame 20 is connected to the housing 42 of the backup tong 40. The wrenching tong 30 is disposed above the backup tong 40. The housing 32 of the wrenching tong 30 is designed to allow the frame 20 to be attached to the backup tong 40. As shown in FIG. 1, the housing 32 of wrenching tong 30 is partially truncated in comparison to the housing 42 of the backup tong 40. FIG. 2 shows the backup tong 40 with a portion of its housing 42 removed. It can be seen that the backup tong 40 includes a pair of column supports 47, 48 for connection with the columns 7, 8 of the frame 20.

Figure 6:
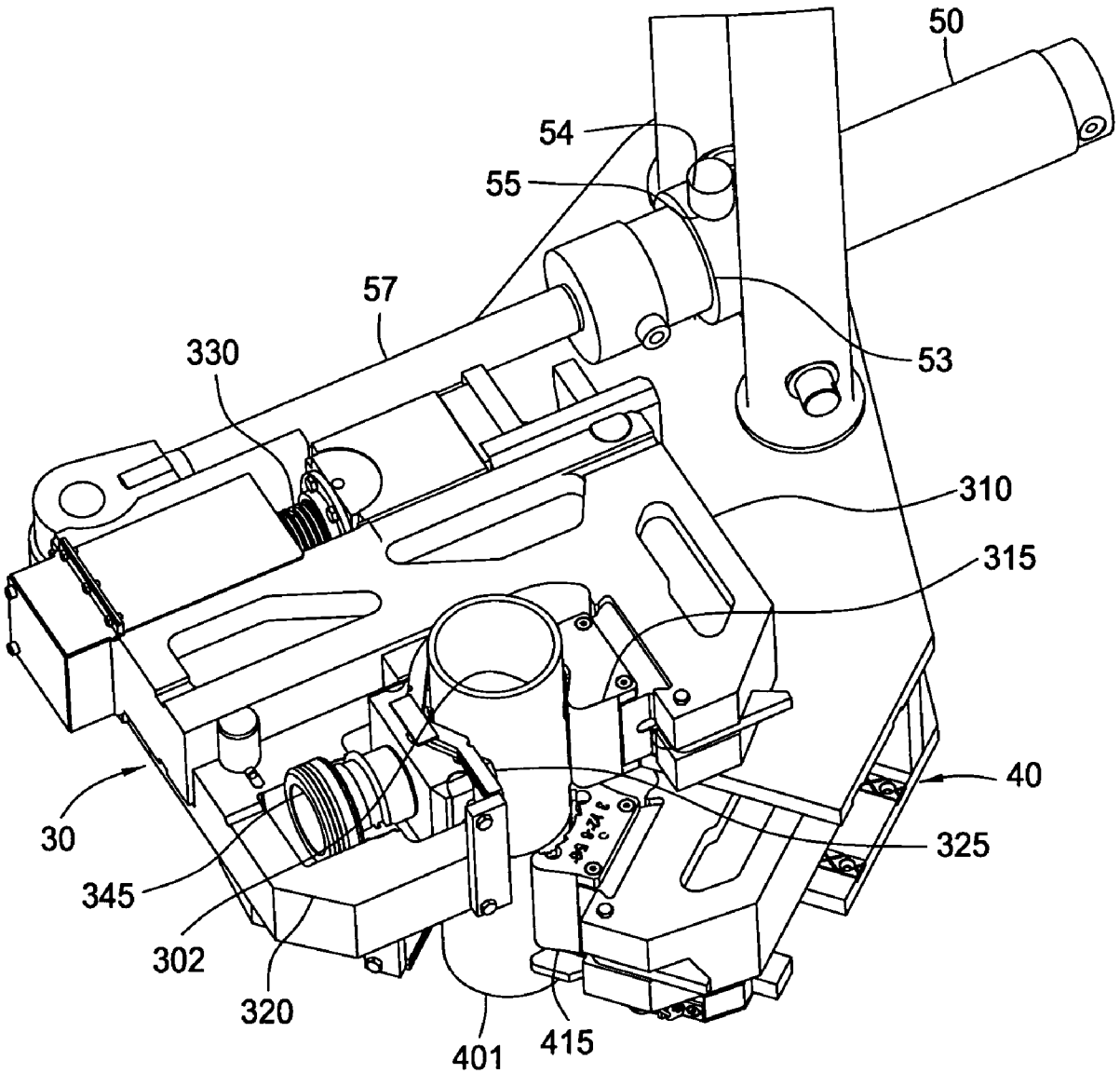
FIG. 6 shows the wrenching tong rotated relative to the backup tong. Additionally, the wrenching tong is engaged with a tubular.

Referring back to FIG. 1, a wrenching cylinder 50 is used to apply torque to the wrenching tong 30. The wrenching cylinder 50 is mounted to the frame 20 using a cylinder support member 52. Particularly, the wrenching cylinder 50 is pivotably connected to the frame 20 and the wrenching tong 30. In one embodiment, a pivotable mechanism connecting the wrenching cylinder 50 to the frame 20 includes a collar 53 disposed around the wrenching cylinder 50, as illustrated in FIG. 6. The collar 53 having an indexing member 54 extending through an indexing opening 55 in the cylinder support member 52. The pivotable mechanism allows the wrenching cylinder 50 to pivot relative to the frame 20 as it rotates the wrenching tong 30. Additionally, a second pivotable mechanism is used to connect the wrenching cylinder 50 to the wrenching tong 30. In one embodiment, the second pivotable mechanism includes a pin 56 in the housing 32 of the wrenching tong 30 inserted through the piston 57 of the wrenching cylinder 50. The pivotable mechanisms work together to provide rotational movement to the wrenching tong 30. Preferably, the center of rotation of the wrenching tong 30 shares the same or substantially the same center of the tubular connection. In one aspect, the wrenching cylinder 50 may rotate the wrenching tong 30 for an angle up to about 40 degrees relative to the backup tong 40, more preferably, up to about 35 degrees, and most preferably, up to about 30 degrees. Torque is applied to the tubular connection when the wrenching tong 30 is rotated by the wrenching cylinder 50. The wrenching cylinder 50 may be actuated hydraulically, pneumatically, mechanically, or combinations thereof. The applied torque is proportional to the pressure of the wrenching cylinder 50. It must be noted that other suitable pivotable mechanisms may be used as is known to a person of ordinary skill in the art.

In another aspect, the tongs 30, 40 of the tong assembly 100 include a novel gripping arrangement or clamping system for retaining a tubular. In the embodiment shown in FIG. 1, both the wrenching tong 30 and the backup tong 40 are equipped with the same clamping system. Therefore, the discussions herein with respect to the clamping system apply to both tongs 30, 40, unless otherwise indicated.

Referring to FIG. 2, the clamping system or gripping arrangement includes an active clamping member 110 operatively coupled to a passive clamping member 120. The active clamping member 110 is movably disposed in the housing 42, and the passive clamping member 120 is fixed to the housing 42. Each clamping member 110, 120 is provided with a gripping member, such as a jaw 115, 125, adapted to engage a tubular. The clamping members 110, 120 are arranged such that actuation of the active clamping member 110 will move the jaw 115 of the active clamping member 110 closer to the jaw 125 of the passive clamping member 120, thereby engaging the tubular. The clamping arrangement can also be seen in FIG. 3, which is a cross-sectional view of the wrenching tong 30.

Figure 3:
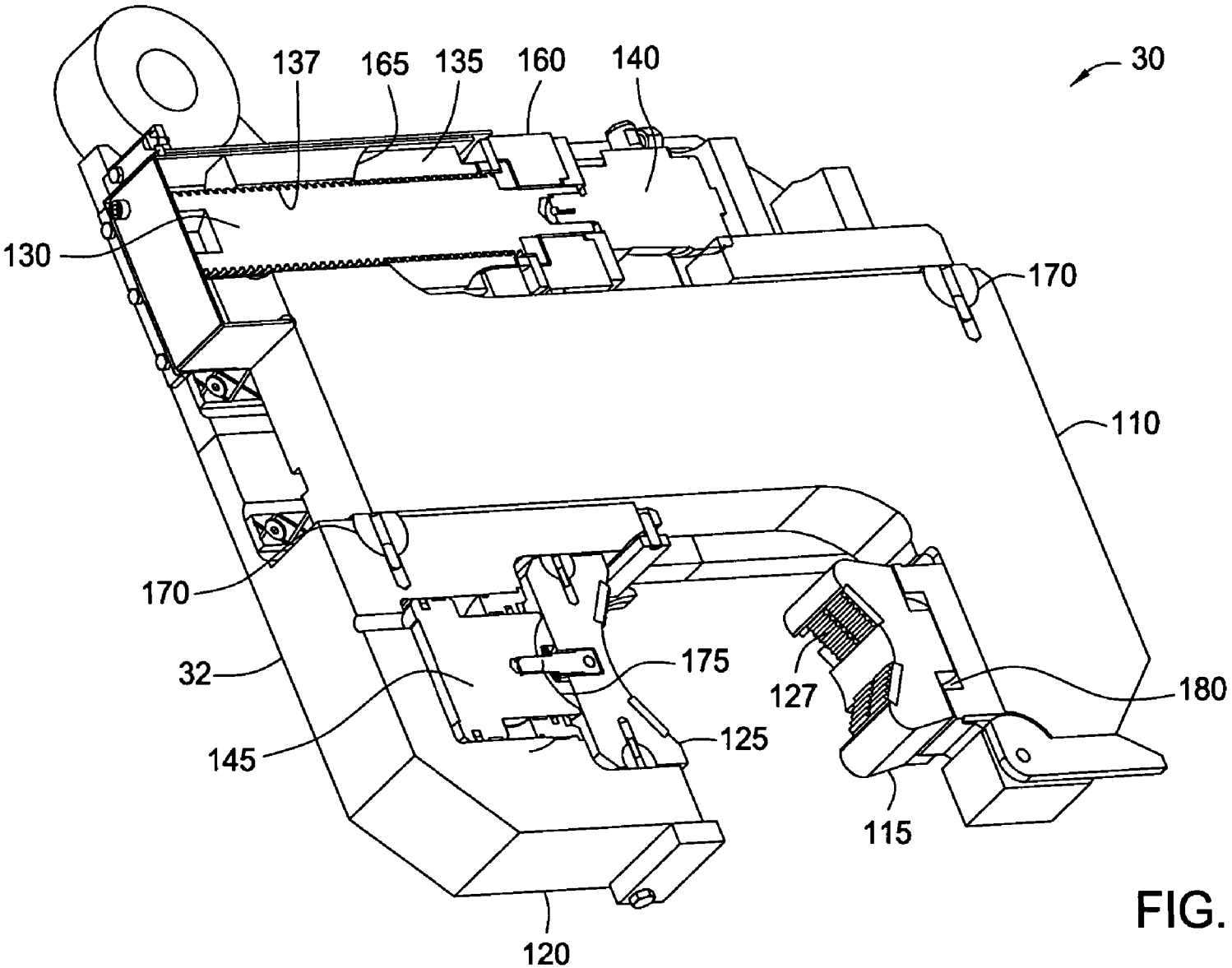
FIG. 3 is a cross-sectional view of the wrenching tong.

In one embodiment, a spindle 130 is used to actuate the active clamping member 110. Referring to FIGS. 2 and 3, the spindle 130 is threadedly coupled to a nut 135 attached to the active clamping member 110. The spindle 130 is actuated by a hydraulic motor 140. During operation, the positions of the spindle 130 and the motor 140 remain stationary relative to the housing 42. As the spindle 130 is rotated by the motor 140, the nut 135 moves along the threads 137 of the spindle 130, thereby moving the active clamping member 110 relative to the passive clamping member 120. In another embodiment, the active clamping member 110 may be actuated by a piston and cylinder assembly. Extension or retraction of the cylinder assembly will result in a corresponding movement of the active clamping member 110.

In one aspect, the tong body is adapted to handle various tubular sizes. Unlike conventional tongs, the tong according to aspects of the present invention may change its body size to handle different size tubulars. Particularly, the tong body includes an active clamping member 110 operatively coupled to a passive clamping member 120. During operation, the active clamping member 110 may be adjusted relative to the passive clamping member 120 to accommodate the new tubular, or to approximate the diameter of the new tubular. In this respect, the overall body size of the tong is changed.

Figure 4:
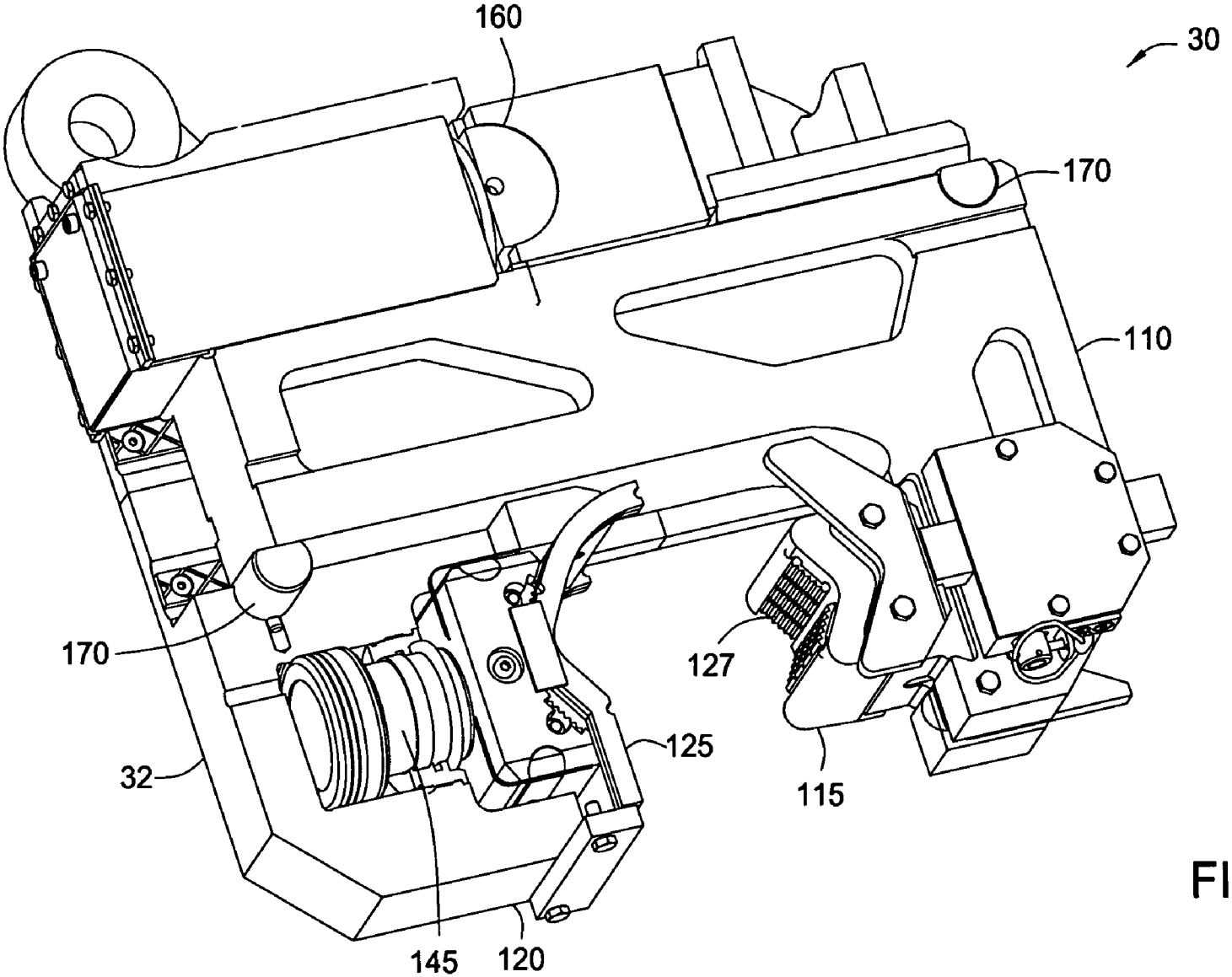
FIG. 4 depicts the wrenching tong with a portion of its housing removed for clarity.

After the clamping members 110, 120 bring the jaws 115, 125 into engagement with the tubular, the jaws 115, 125 may be actuated to apply the clamping pressure on the tubular. FIG. 4 depicts the wrenching tong 30 with a portion of its housing 32 removed. A clamping cylinder 145 may be seen coupled to the jaw 125 on the passive clamping member 120. In this respect, this jaw 125 is also known as the active jaw 125 and may be actuated by a clamping cylinder 145 to apply the clamping force. The jaw 115 on the active clamping member 110, also known as the passive jaw 115, cooperates with the active jaw 125 to engage the tubular. It is also contemplated that either or both jaws may be an active jaw or a passive jaw. It is further contemplated that the clamping cylinder may be actuated hydraulically, pneumatically, mechanically, or combinations thereof without deviating from the aspects of the present invention.

To further facilitate engagement with the tubular, one or more dies 127 may be mounted on the jaws 115, 125. The dies 127 may be replaced as necessary without replacing the jaws 115, 125. Typically, the dies 127 are replaced when worn, or when the characteristics of the tubular changes. In another embodiment, teeth may be formed directly on the jaws 115, 125 to facilitate engagement.

In another aspect, the load bearing components in the tongs 30, 40 of the present invention may be adapted to withstand the forces necessary to makeup or breakout the tubular connection. It is believed that due to these forces, the clamping system may, in some instances, elastically deform. To reduce the potential for elastic deformation, the clamping system of the present invention includes features which assist in resisting deformation. In one embodiment, the spindle 130 is fitted with a cylindrical bearing 160, as shown in FIG. 2. Also, a spherical contact surface 165 is provided between the nut 135 and the active clamping member 110, as shown in FIG. 3. The cylindrical bearing 160 or the spherical contact surface 165 may act to reduce the potential for the spindle 130 to bend.

In another embodiment, the active clamping member 110 is in contact with the housing 32, 42 through one or more force distributors. Particularly, the force distributor comprises a pendulum bolt 170 having a flat surface on one end and an arcuate surface on another end. As shown in FIGS. 2 and 4, each tong 30, 40 is equipped with two pendulum bolts 170. The pendulum bolts 170 are disposed between the active clamping member 110 and the housing 32, 42. When the active clamping member 110 encounters a torque, the torque is transferred to the pendulum bolts 170, which in turn, distributes the torque to the housing 32, 42. Further, the pendulum bolts 170 are also self aligning. In this respect, the forces may be transferred through a maximum contact area.

Similarly, the jaws 115, 125 also have features to resist deformation. In one embodiment, the clamping cylinder 145 is in contact with the active jaw 125 through a spherical bearing 175, as illustrated in FIG. 3. In this respect, the piston of the clamping cylinder 145 is protected. In another embodiment, a spherical bearing 180 is disposed between the passive jaw 115 and the active clamping member 110. The spherical bearing 180 protects the passive jaw 115 and aligns the passive jaw 115 to the tubular surface.

Figure 5:
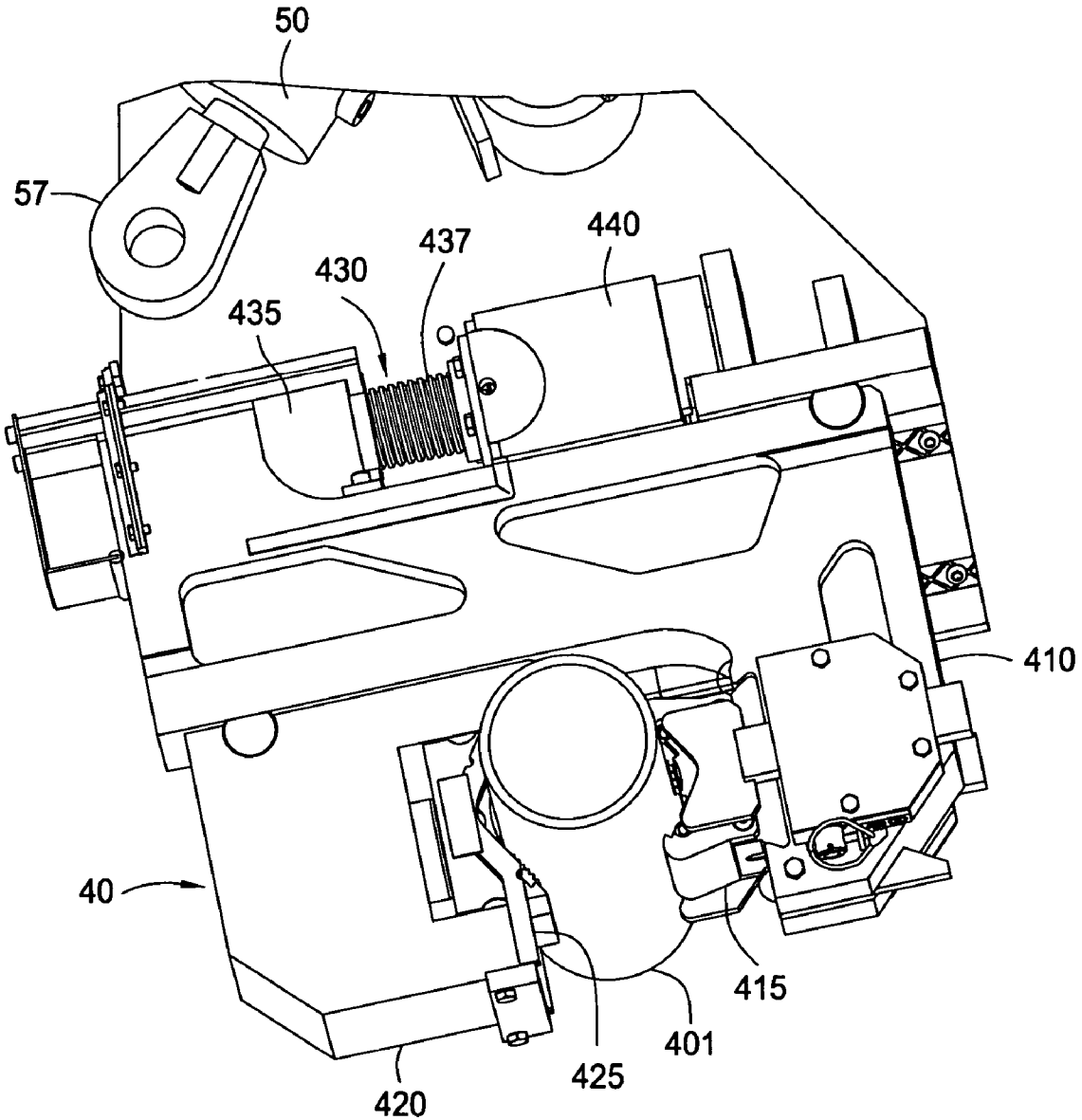
FIG. 5 illustrates the backup tong in engagement with a tubular.
Figure 7:
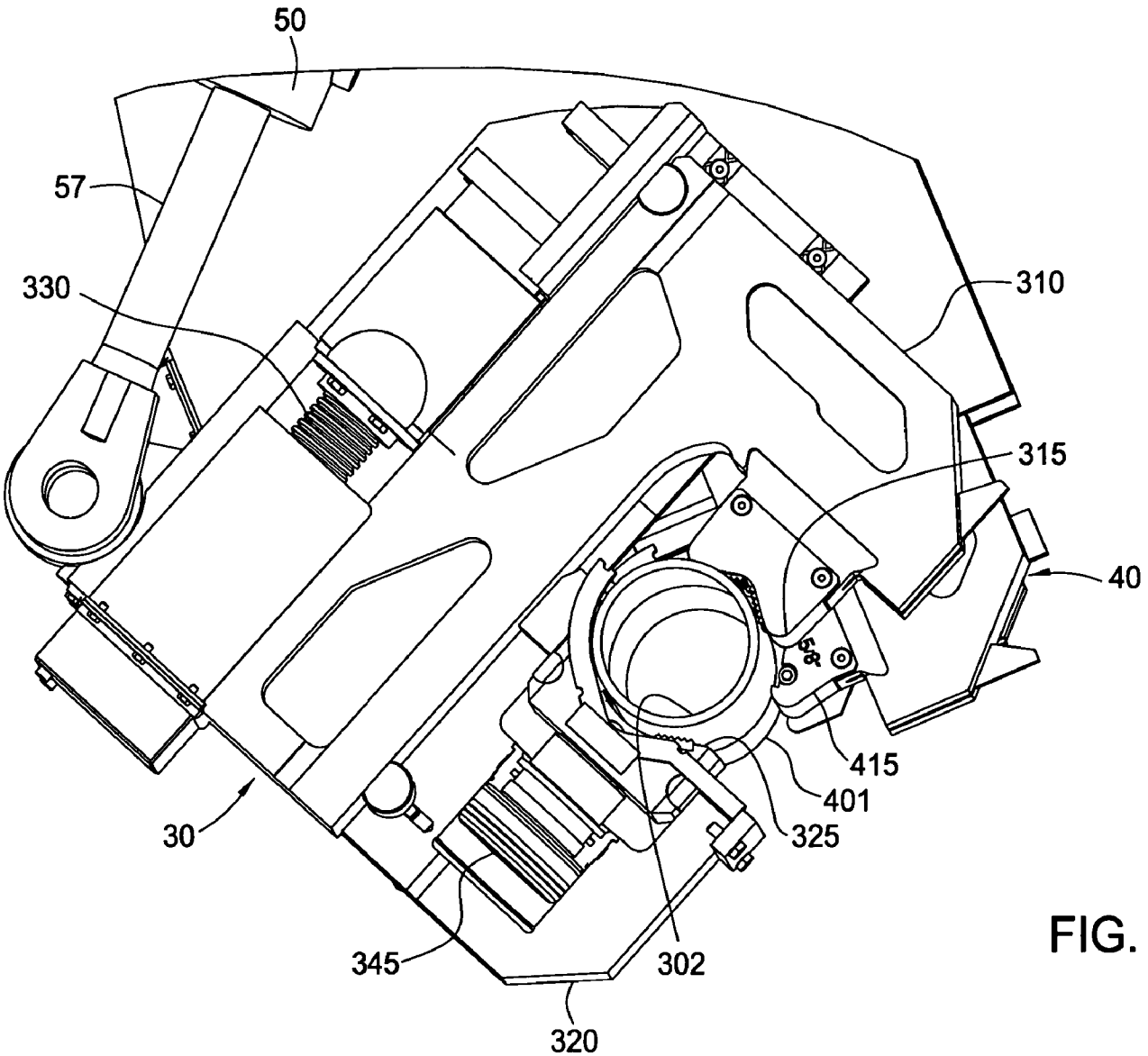
FIG. 7 shows the wrenching cylinder partially retracted, and the wrenching tong partially rotated back into alignment with the backup tong.

In operation, the tong assembly 100 may be used to connect a first tubular 401 to a second tubular 302. Initially, the tongs 30, 40 are aligned and open to receive the tubulars 401, 302, as illustrated in FIG. 1. The frame 20 is then moved to position the jaws 315, 325, 415, 425 around the tubulars 401, 302 to be connected, as shown in FIGS. 5-7. Preferably, the jaws 415, 425 of the backup tong 40 are positioned to engage the first tubular 401, and the jaws 315, 325 of the wrenching tong 30 are positioned around the second tubular 302.

After the tongs 30, 40 are placed into position, the active clamping member 410 of the backup tong 40 is actuated to move the jaws 415, 425 into engagement with the first tubular 401. Particularly, the motor 440 is actuated to rotate the spindle 430, thereby causing the nut 435 to move along the threads 437 of the spindle 430. As a result, the jaws 415, 425 are moved into engagement with the first tubular 401. FIG. 5 illustrates the backup tong 40 in engagement with the first tubular 401. It can be seen that the nut 435 has moved along the spindle 430, thereby exposing a threaded portion 437 of the spindle 430. After the first tubular 401 is engaged, the clamping cylinder of the active jaw 425 is actuated to apply the proper gripping force against the first tubular 401.

Thereafter, the wrenching cylinder 50 is actuated to rotate the wrenching tong 30 about the center of the second tubular 302. As shown in FIG. 6, actuation of the wrenching cylinder 50 extends the piston away from the cylinder support member 52 and rotates the wrenching tong 30 relative to the backup tong 40. During actuation of the wrenching cylinder 50, it is preferred that a spinner is used to partially makeup the tubulars 401, 302. Generally, spinners are capable of quickly making up the connection at low torque but high speed. The spinner may optionally be disposed on the frame 20 to partially makeup the connection while the piston 57 of the wrenching cylinder 50 is extended. In this manner, valuable time can be saved.

After the piston 57 is extended, the active clamping member 310 of the wrenching tong 30 is actuated. The spindle 330 is rotated to cause the active clamping member 310 to move the jaws 315, 325 into engagement with the second tubular 302. Then, the clamping cylinder 345 is actuated to apply the proper gripping force to the jaws 315, 325. In FIG. 6, the wrenching tong 30 is shown engaged with the second tubular 302. In addition, the wrenching tong 30 has been rotated about 30 degrees relative to the backup tong 40.

Torque may now be applied to makeup the connection. Torque is supplied by the wrenching cylinder 50 by retracting the piston 57. Retraction of the piston 57 causes the wrenching tong 30 to rotate, thereby rotating the second tubular 302 relative to the first tubular 401. FIG. 7 shows the piston 57 partially retracted and the wrenching tong 30 partially rotated back into alignment with the backup tong 40. Thereafter, the spindle 330 may be actuated to move the active clamping member 310 back to the open position. If necessary, the process may be repeated for the active clamping member 310 to fully makeup the tubular connection.

The tong assembly 100 may also be used to disconnect tubulars 401, 302. After the backup tong 40 has engaged the first tubular 401, the active clamping member 310 of the wrenching tong 30 may be actuated to move the jaws 315, 325 into engagement with the second tubular 302. The active jaw 325 is then actuated to apply the gripping force. Thereafter, the piston 57 is extended to rotate the wrenching tong 30. In turn, the second tubular 302 is rotated relative to the first tubular 401 to be disconnected therefrom.

The tong according to aspects of the present invention may optionally be remotely operated. In one aspect, the movement of the components of the tong may be operated from a remotely placed control panel. In another aspect, the tong may be configured to perform the tubular make up or break up process autonomously, e.g. in accordance with a computer program. Particularly, the tong may include any suitable interface for performing the process.

In another aspect still, the tong may include one or more sensors to facilitate its operation. In one embodiment, the tong may include proximity sensors to determine the location of the tubular. In another embodiment, the tong may include sensors for determining the torque or force applied. Additional sensors may be included as is known to a person of ordinary skill in the art.

The present invention also provides a spinner for making and breaking tubular connections. The spinner may be used in combination with the tong assembly to make up or break out tubular connections. In one embodiment, the spinner includes a body and two arms for retaining the tubular. The spinner is equipped with one or more rollers to frictionally engage the tubular and transfer torque thereto. Preferably, three rollers are positioned on the spinner such that a three point contact with the tubular is established. Specifically, a roller is disposed on each arm and a third roller is disposed on the body. The arms are adjustable to accommodate tubulars of different sizes.

Figure 8:
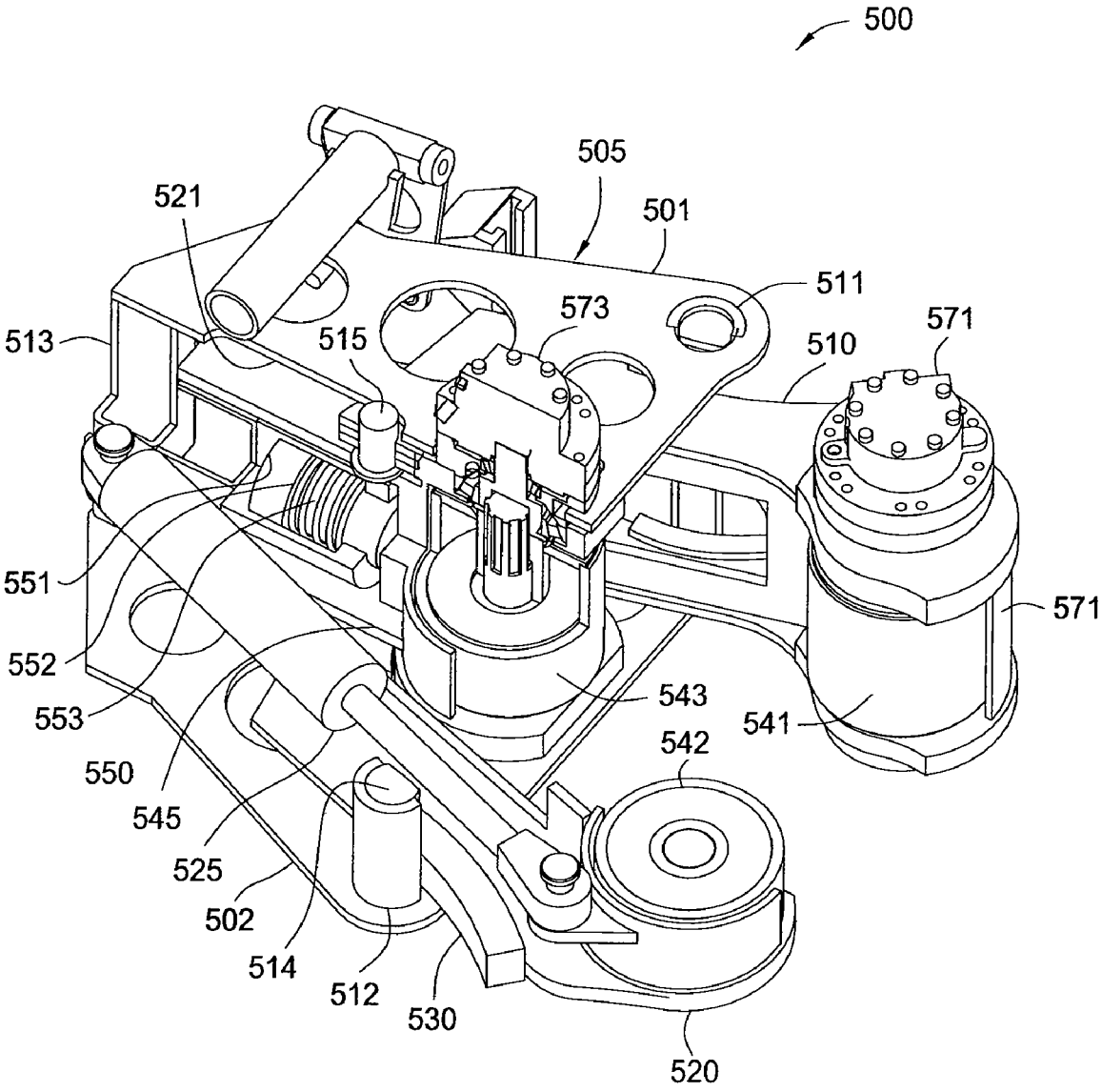
FIG. 8 shows a spinner according to aspects of the present invention. A portion of the spinner is shown in cross-section.

FIG. 8 shows an exemplary embodiment of a spinner 500 according to aspects of the present invention. The spinner 500 includes two arms 510, 520 movably attached to a housing 505. The housing 505 comprises two plates 501, 502 connected together using three posts 511, 512, 513. Two guide posts 511, 512 are located on each side of the front end, and one back post 513 is centrally located at the back end.

Figure 9:
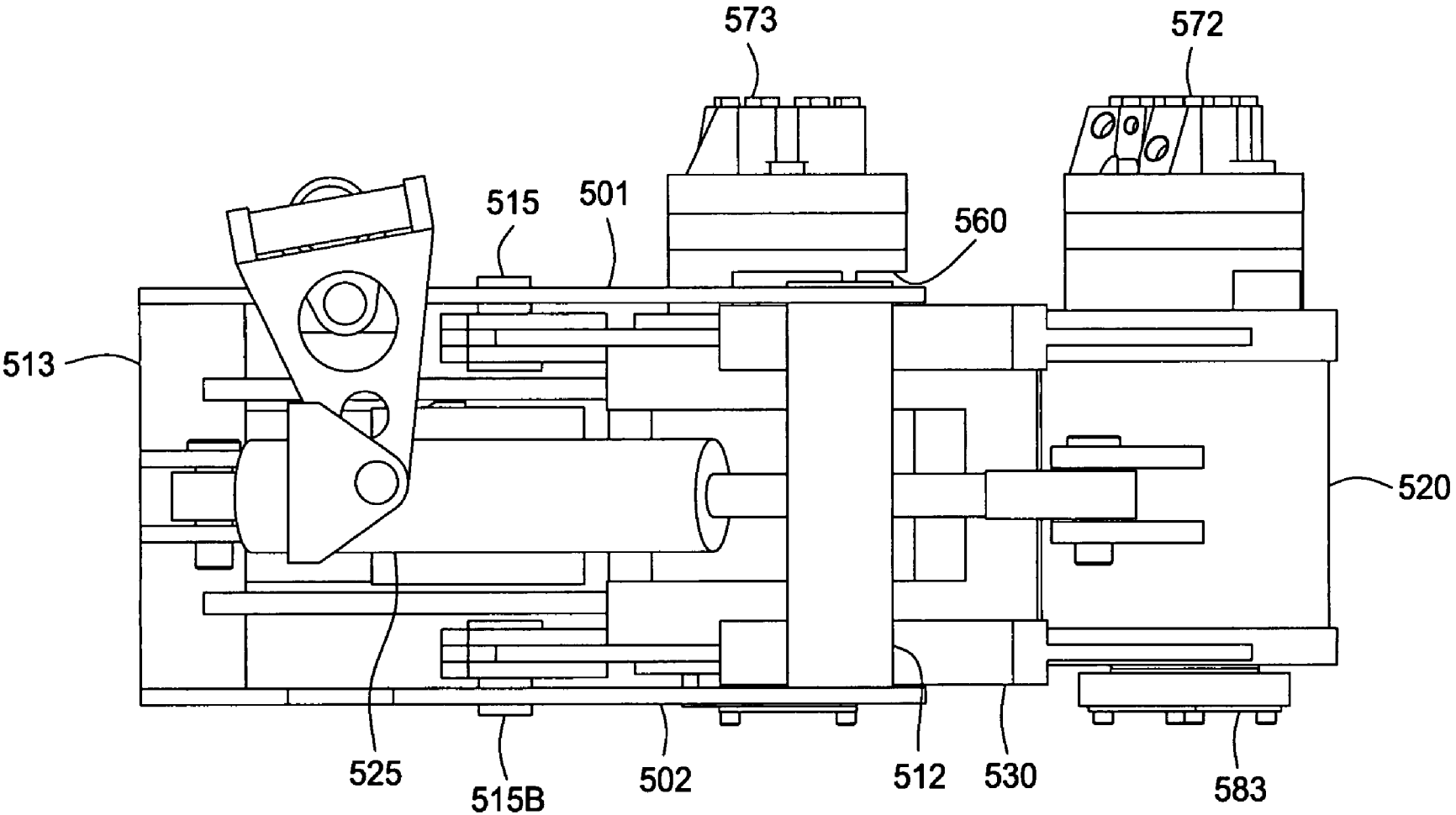
FIG. 9 is a side view of the spinner.

The two arms 510, 520 are at least partially disposed interior to the housing 505 and are pivotally coupled together using one or more guide keys 515. The back end of each arm 510, 520 has an upper flange and a lower flange extending inwardly. The upper flanges of the arms 510, 520 are coupled together using a guide key 515 inserted through a hole formed in the flanges. The guide key 515 extends through the upper flanges of the arms 510, 520 and into a guide slot 521 formed in the top plate 531. This can be more clearly seen in FIG. 9, which is a side view of the spinner 500. Preferably, the guide slot 521 is centrally located and extends from front to back. The lower flanges are similarly coupled to a second guide key 515B and guide slot (not shown) combination. The guide key 515, 515B and guide slot 520 combination directs the movement of the arms 510 during extension or retraction. As the guide key 515 moves along the guide slot 521, the two arms 510, 520 are allowed to pivot about the guide key 515. It must be noted that the arms 510, 520 may be coupled using only one guide key and guide slot combination.

Figure 10:
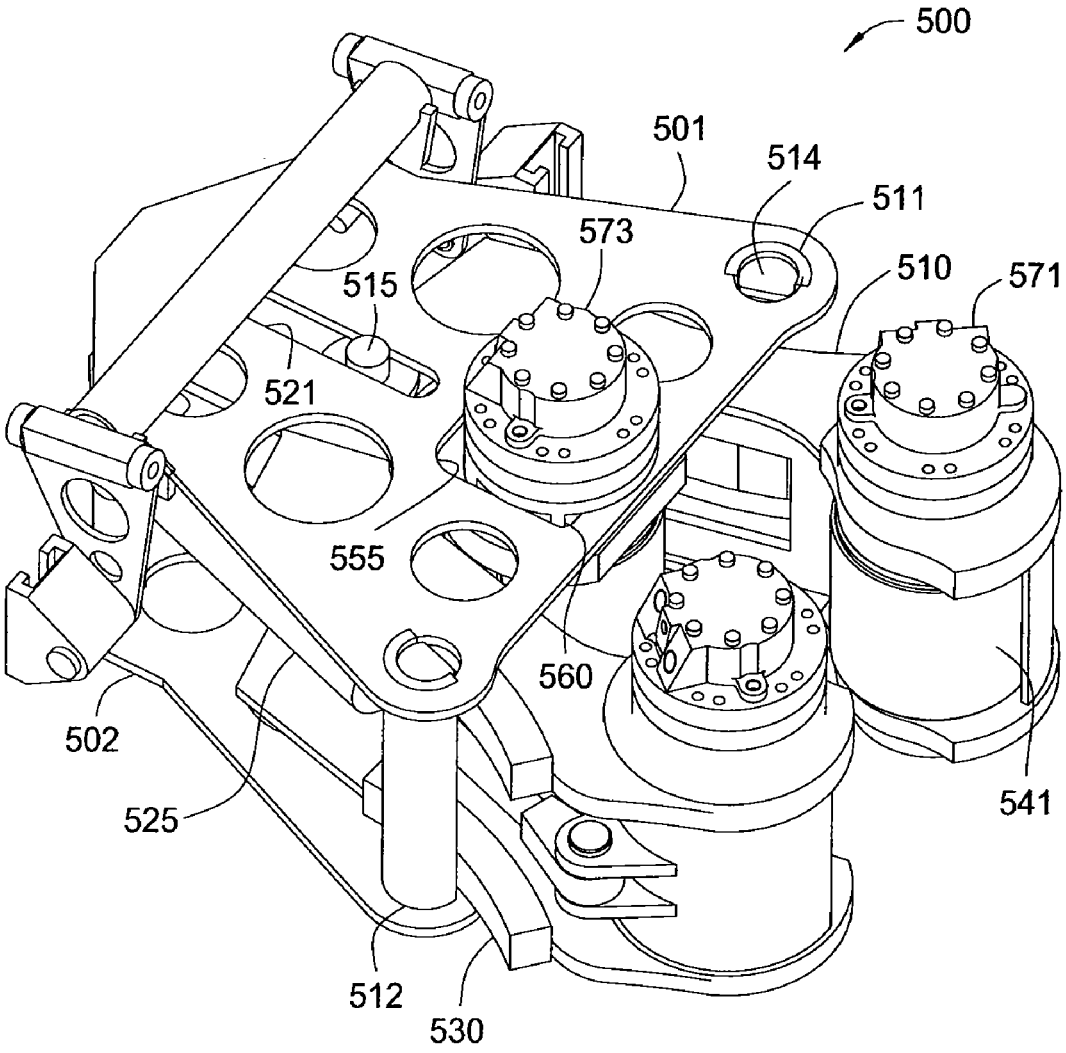
FIG. 10 is a perspective view of the spinner.

Each arm 510, 520 is actuated by a piston and cylinder assembly 525. One end of the cylinder assembly 525 is hinged to the side of the arm 510, 520, and the opposite end of the cylinder assembly 525 is hinged to the back post 513. The piston and cylinder assembly 525 may be hydraulically or pneumatically operated. Actuation of the piston and cylinder assembly 525 extends or retracts the arms 510, 520 during operation. The arms 510, 520 are in contact with the guide posts 511, 512 through a cam 530 disposed on the side of the arms 510, 520. The cam 530 defines an arcuate shaped member adapted to force the respective arm 510, 520 to move inward as it is retracted and outward as it is extended, as shown in FIG. 10, which is a cross-sectional top view of the spinner 500. Preferably, each guide post 511, 512 includes a pivotable guide rod 514 with an arcuate surface to facilitate movement of the cam 530 against the guide post 511, 512. As shown, each arm 510, 520 includes an upper cam and a lower cam.

The spinner 500 is equipped with three rollers 541, 542, 543 for contacting and rotating a tubular. Referring back to FIG. 8, an arm roller 541, 542 is disposed on the front end of each arm 510, 520. The arm rollers 541, 542 are situated such that at least a portion of the rollers 541, 542 is available for contacting with an outer surface of the tubular to be handled. Preferably, the rollers 541, 542 are angled inwardly to facilitate engagement with tubulars of various sizes. A central roller 543 is positioned in a roller support seat 545 and movably disposed in the housing 505. The roller support seat 545 is coupled to a load cylinder 550 such that the load cylinder 550 can extend or retract the roller support seat 545 towards and away from contact with the tubular. In one embodiment, the cylinder housing 551 of the load cylinder 550 is fixed to the spinner housing 505, while the piston 552 of the load cylinder 550 is attached to a back portion of the roller support seat 545. During operation, extension of the piston 552 pushes the central roller 543 into contact with the tubular, and retraction of the piston 552 pulls the central roller 543 away from the tubular. Preferably, a biasing member such as spring 553 is disposed in the load cylinder 550 to bias the piston 552 in the retracted position. To control the movement of the central roller 543, a top portion of the central roller 543 extends through a roller guide slot 555 in the top plate 501. The front end of the top portion has a recess 560 to accommodate the top plate 501 as the central roller 543 is moved along the roller guide slot 555.

Figure 11:
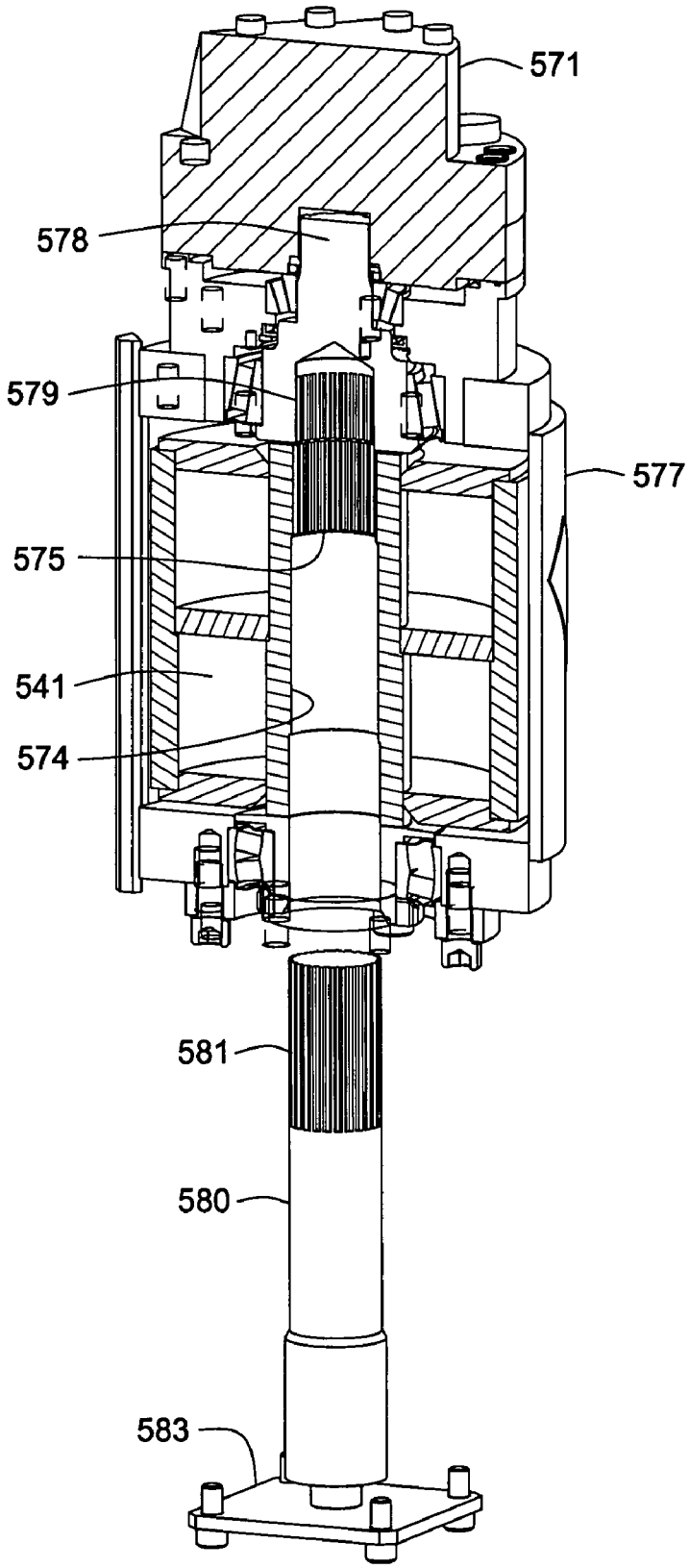
FIG. 11 is a cross-sectional view of a roller and motor assembly.

In another aspect, the rollers 541, 542, 543 are driven by a motor 571, 572, 573 coupled thereto. FIG. 11 shows a roller and motor assembly suitable for use with the present invention. The roller 541 defines a tubular member having an axial bore 574. The upper portion of the bore 574 includes a splined surface 575. Preferably, the roller 541 is partially cased in a protective body 577. The protective body 577 has openings above and below the roller 541. The motor 571 is disposed above the protective body 577 and partially through the top opening of the protective body 577. The motor 571 includes a drive shaft 578 having a splined bore 579 aligned with the bore 574 of the roller 541. A roller shaft 580 is inserted through the bottom opening of the protective body 577, the bore 574 of the roller 541, and the bore 579 of the motor drive shaft 578. A spline 581 formed on an upper portion of the roller shaft 580 mates with the splines 575, 579 of the roller 541 and the motor drive shaft 578. In this respect, torque applied to the drive shaft 578 may be transferred to the roller shaft 580 and then to the roller 541. A base plate 583 is attached to the protective body 577 to close off the bottom opening and retain the roller shaft 580. This arrangement allows the roller 541 to be removed from the protective body 577 simply by removing the base plate 583 and the roller shaft 580. Although the embodiments are shown with three motor driven rollers, it must be noted that only one of the rollers needs to be powered. For example, the central roller 543 in the housing 505 may be powered (active) while the rollers 541, 542 on the arms 510, 520 are not (passive). In this arrangement, the torque for rotating the tubular comes from the active roller 543. The passive rollers 541, 542 only act to facilitate rotation of the tubular and retain the tubular. It must also be noted that the spinner 500 may be equipped with any number of rollers or rollers of different sizes. For example, instead of one roller, two smaller rollers may be disposed in the housing 505, so that four rollers may come into contact with the tubular. Additionally, the rollers on the arms 510, 520 may be powered while the rollers in the housing 505 are not.

In operation, a drill pipe string is held in the wellbore by a spider. To extend the drill pipe string, a section of drill pipe 503 is positioned above the drill pipe string and then connected thereto. The tubular connection process requires the drill pipe section 503 to be stabbed into the drill pipe string. The spinner 500 is then used to quickly make up the threaded connection between the drill pipe section 503 and the drill pipe string. Although a drill pipe connection is described, aspects of the present invention may be used to connect a casing, a tubing, and other downhole tubulars as is known in the art.

Figure 12:
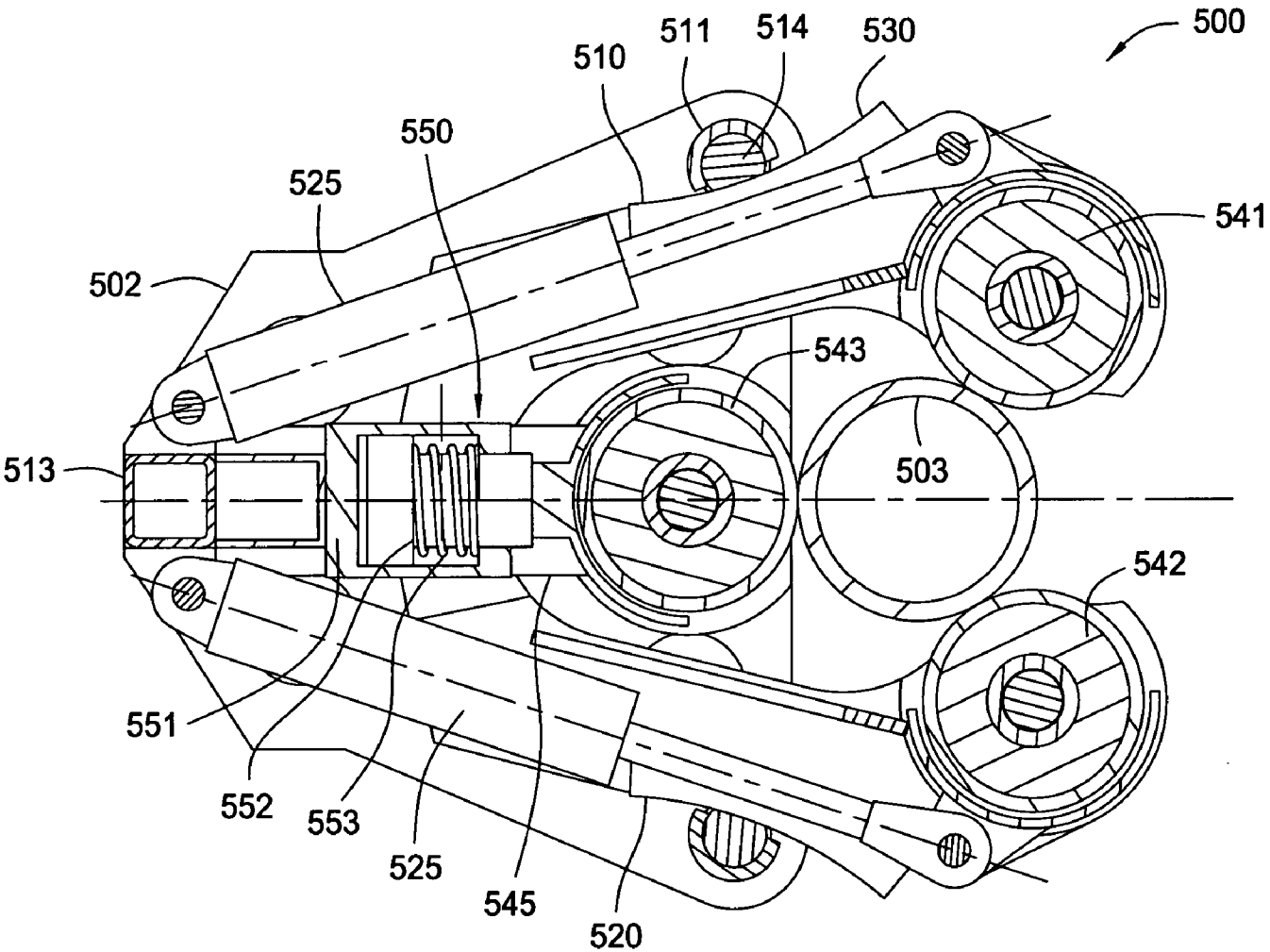
FIG. 12 is a cross-sectional top view of the spinner engaged with a large diameter tubular.

To engage the drill pipe section 503, the arms 510, 520 of the spinner 500 are initially in the open position as shown in FIG. 8. The spinner 500 is positioned such that the drill pipe section 503 is between the arms 510, 520. The arm cylinders 525 are actuated to bring the arms 510, 520 into contact with the drill pipe section 503. Thereafter, the arm cylinders 525 continue to retract in order to pull the spinner 500 toward the drill pipe section 503 until all three rollers 541, 542, 543 are in contact with the drill pipe section 503, as shown in FIG. 12. FIG. 12 is a cross-sectional top view of the spinner 500. As the arms 510, 520 are retracted, the guide key 515 moves along the guide slot 521 in a direction toward the back post 513 and pivot about the guide key 515 as the cams 530 on the arms 510, 520 cause the rollers 541, 542 on the arms 510, 520 to move closer to each other. Because the arms 510, 520 are coupled together, the arms 510, 520 are retracted simultaneously and at the same speed. Additionally, the cams 530 causes the arms 510, 520 to move the arm rollers 541, 542 closer together, thereby adjusting to the size of the drill pipe 503 being retained.

In some instances, the contact force from larger drill pipe sections will push back the central roller 543, the roller support seat 545, and the piston 553 of the load cylinder 550. After all three rollers 541, 542, 543 come into contact with the drill pipe section 503, the arm cylinders 525 are closed by a check valve to maintain the position of the arms 510, 520. Then, hydraulic fluid is supplied to the load cylinder 545 to actuate the piston 552. In turn, the piston 552 urges the central roller 543 against the drill pipe section 503 and supplies the desired load to the rollers 541, 542, 543 to clamp the drill pipe section 503. Referring to FIG. 12, the drill pipe section 503 is engaged by the three rollers 541, 542, 543, and a centerline of the drill pipe section 503 is at least substantially aligned with a diameter of the central roller 543. Additionally, the centers of the arms rollers 541, 542 are equidistance from the centerline of the drill pipe section 503. When fully engaged, the motors 571, 572, 573 of the rollers 541, 542, 543 are hydraulically actuated to transfer torque to the rollers 541, 542, 543 through frictional contact. In this manner, the drill pipe section 503 is rotated to make up the drill pipe connection.

Figure 13:
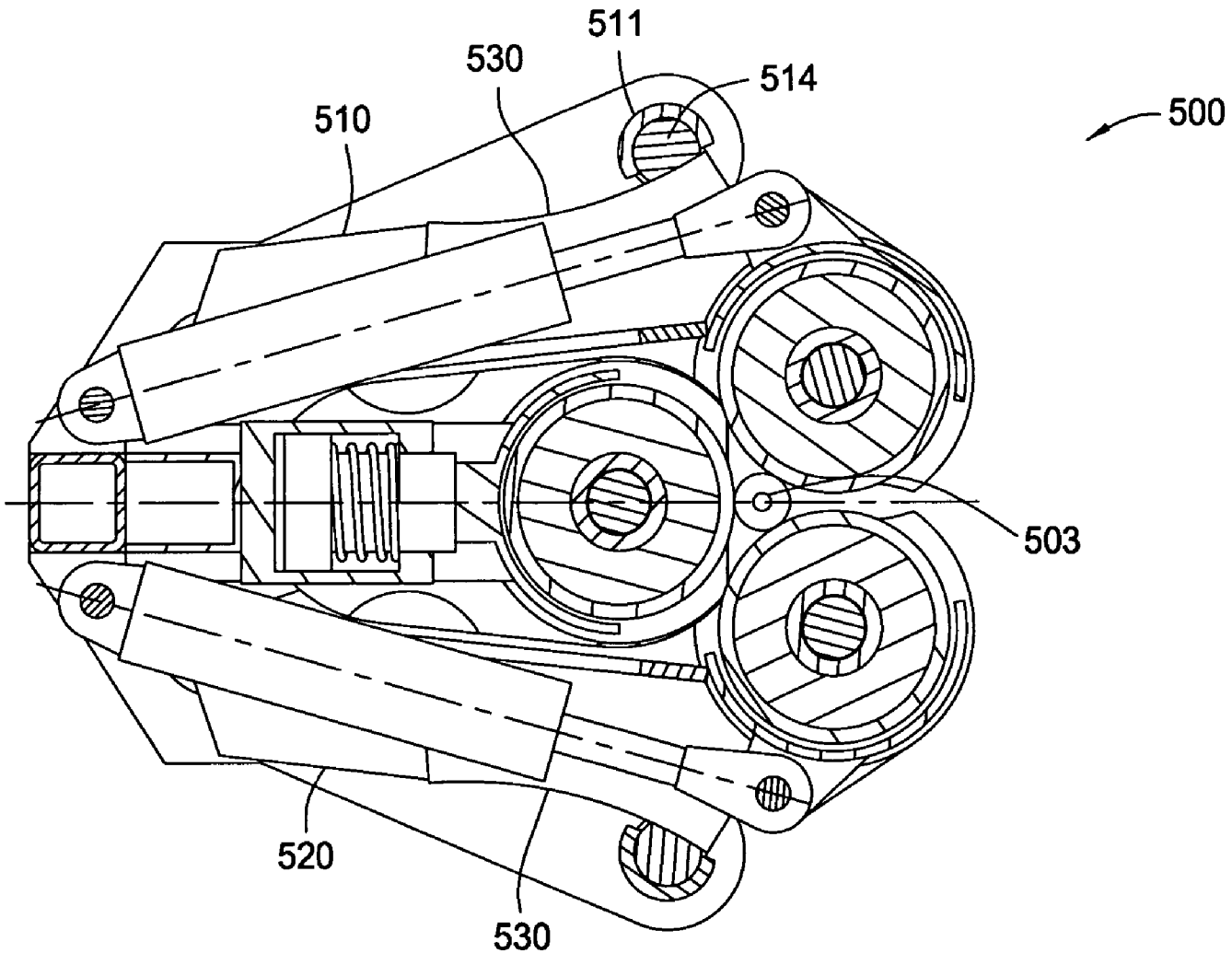
FIG. 13 is a cross-sectional top view of the spinner engaged with a small diameter tubular.

FIG. 13 shows the spinner 500 engaged with a small diameter tubular 503. As shown, the arms 510, 520 have been fully retracted. The guide rod 514 is in contact with an end of the cam 530 on the first arm 510.

Figure 14:
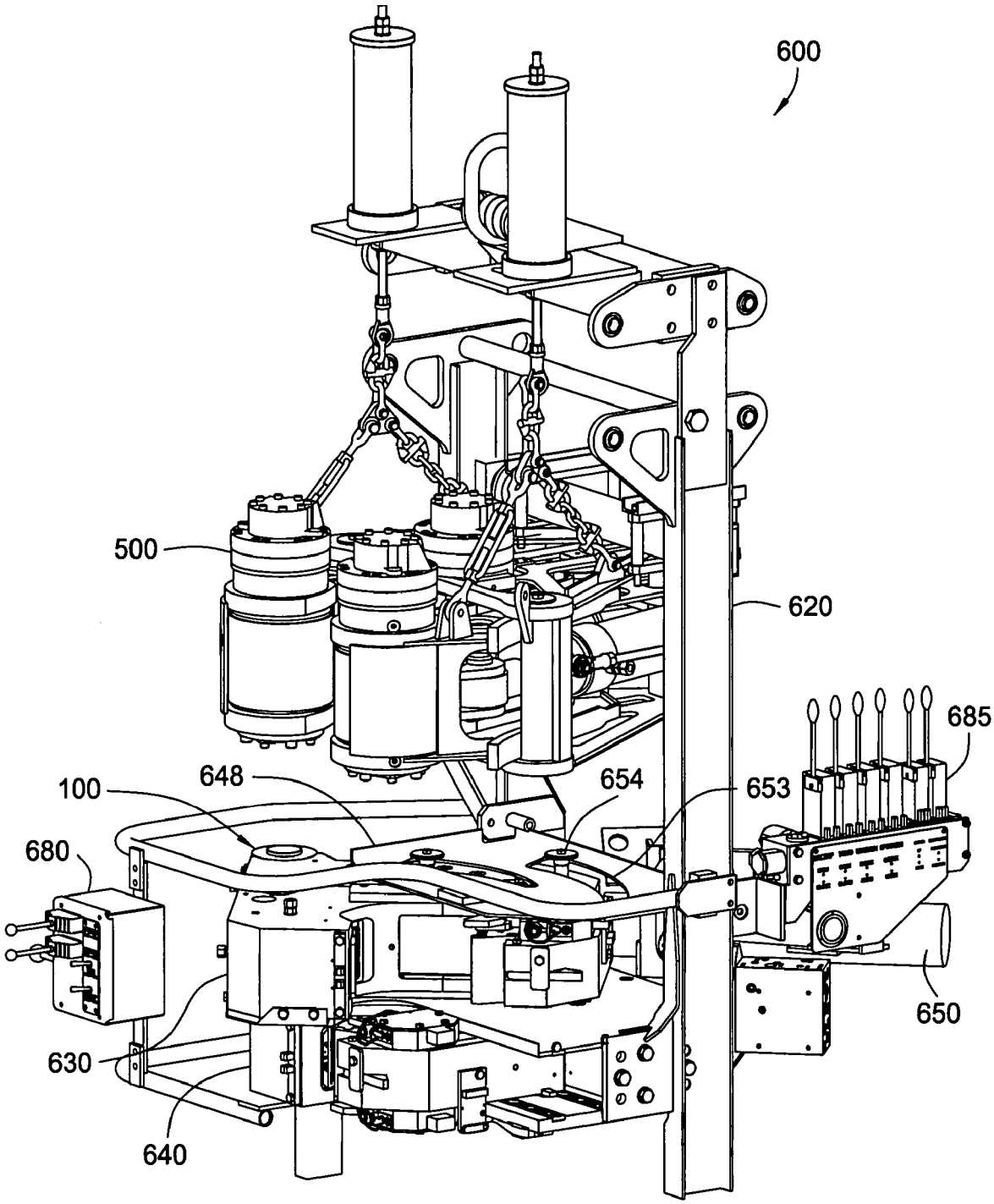
FIG. 14 is a tubular connection unit having a spinner and a tong assembly.

In another aspect, the spinner 500 may be used in combination with the tong assembly 100 to make up or break out a tubular connection. For example, the spinner 500 may be used to partially make up the connection, and the tong assembly 100 may be used to complete the connection by applying a predetermined torque to the connection. In one embodiment, the spinner 500 is positioned above the tong assembly 100 and brought to the well center as one tubular connection unit 600, as shown in FIG. 14. The tubular connection unit 600 may be mounted on a movable frame 620 having moving mechanisms such as wheels, rails, cables or combinations thereof. The spinner 500 and the tong assembly 100 may be attached to the frame 620 in any suitable manner known in the art. The tubular connection unit 600 may also includes one or more controls 680, 685 for operating the unit 600. Initially, the spinner 500 is operated as described with respect to FIGS. 8-12 above to quickly make up a portion of the connection. Thereafter, the tong assembly 100 is operated as described with respect to FIGS. 1-7 to apply a higher torque to complete the tubular connection. In this embodiment, the wrenching tong 630 includes an indexing member 654 coupled to a track 653 formed in a guide plate 648 attached to the frame 620. In this respect, the rotation of the wrenching tong 630 is guided by the indexing member 654 and the track 653 as the wrenching tong 630 is rotated by the wrenching cylinder 650 with respect to the backup tong 640.

In another aspect still, the spinner may include one or more sensors to facilitate its operation. In one embodiment, the spinner may include proximity sensors to determine the location of the tubular. In another embodiment, the spinner may include sensors for determining the torque or force applied. Additional sensors may be included as is known to a person of ordinary skill in the art. In another aspect, operation of the spinner may be automated.

Figure 15:
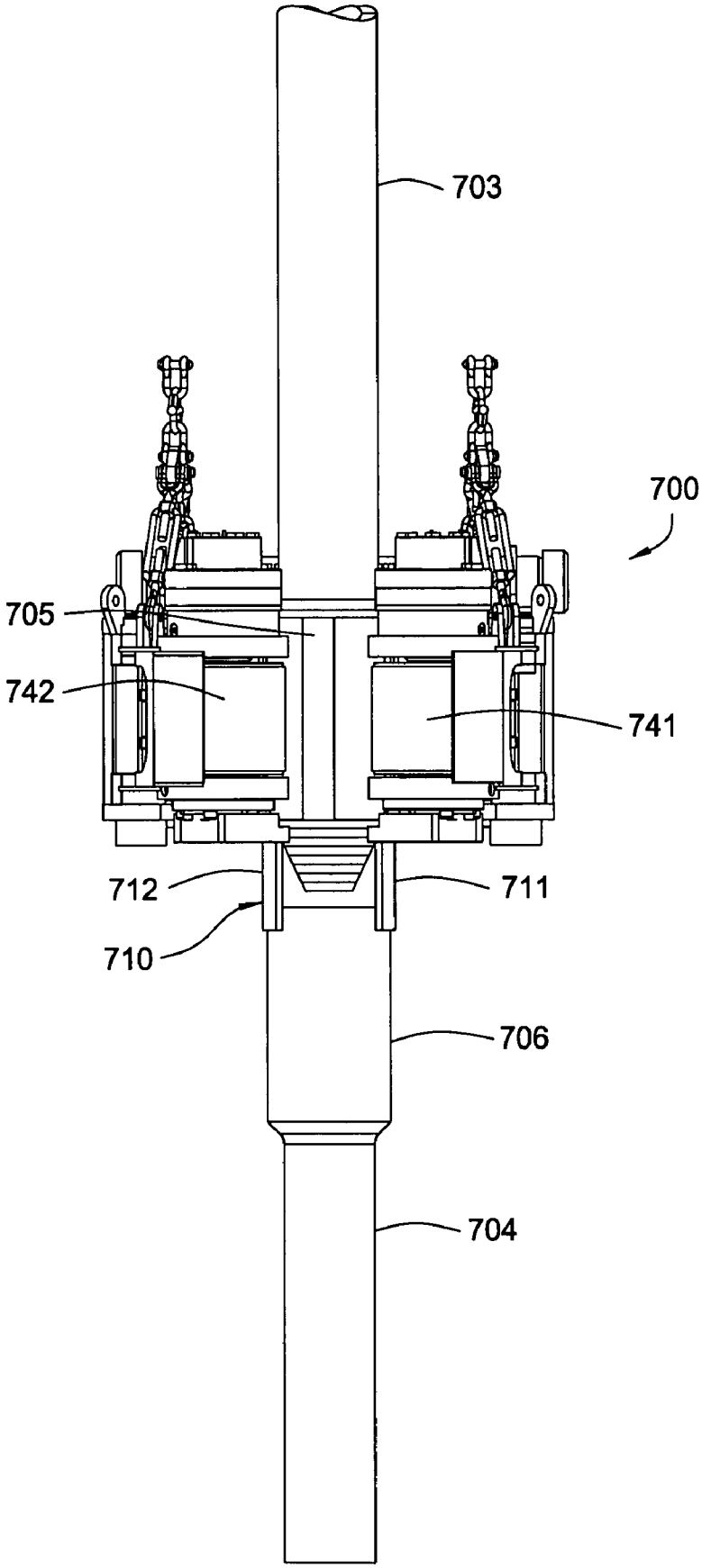
FIG. 15 is a perspective view of the spinner engaging the tubulars before connection.
Figure 16:
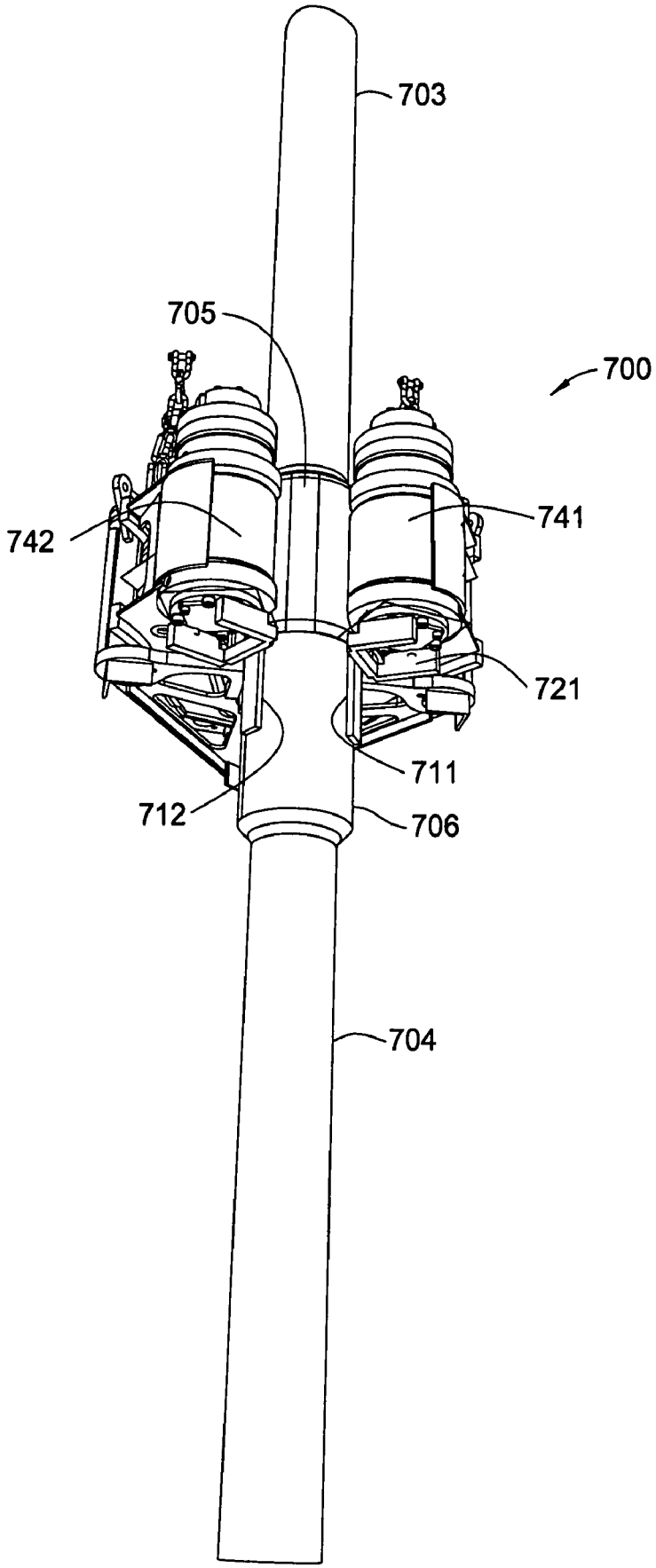
FIG. 16 is a perspective view of the spinner engaging the tubulars after connection.

In another aspect, the spinner 700 may be equipped with a stabbing guide 710 to facilitate the connection of the tubulars. As shown in FIG. 15, the stabbing guide 710 may comprise one or more guide bars 711, 712 attached below each of the three rollers 741, 742 (only two are shown) of the drill pipe spinner 700. The guide bar 711, 712 may be attached to the roller 741, 742 in any suitable manner known to a person of ordinary skill in the art. As shown in FIG. 16, the back of the guide bar 711 is connected to a U shaped body 721, which is attached below the roller 741. Referring back to FIG. 15, the length of the guide bars 711, 712 extending below the rollers 741, 742 is such that the guide bars 711, 712 will overlap at least a portion of the lower drill pipe 704 when the rollers 741, 742 are in contact with the coupling 705 of the upper drill pipe 703. The drill pipe contact surface of the guide bars 711, 712 is flush with the contact surface of the respect roller 741, 742. In this respect, the guide bars 711, 712 will simultaneously align the upper and lower drill pipes 703, 704 for connection when the arms are closed to engage the rollers 741, 742 with the upper drill pipe 703. The guide bars 711, 712 may be optionally equipped with a biasing member such as a spring to reduce the contact force between the guide bar 711, 712 and the tool joints 705, 706. In another embodiment, the guide bars 711, 712 may be installed on only two of the rollers 741, 742.

In operation, the arms of the spinner 700 are actuated to bring the rollers 741, 742 into contact with the upper drill pipe 703. When the rollers 741, 742 contact the upper drill pipe 703, the lower portion of the guide bars 711, 712 also contacts the lower drill pipe 704. The arm cylinders continue to retract the arms until all three rollers 741, 742 contact the upper drill pipe 703. At which point, all of the guide bars 711, 712 are in contact with the lower drill pipe 704, thereby aligning the upper drill pipe 703 for stabbing with the lower drill pipe 704. This alignment is maintained throughout the stabbing and spinning process. FIG. 16 shows the spinner 700 after completing the thread connection.

Use of the stabbing guide 710 is also valuable during the break out process. After spinning out the thread and just before pulling of the upper drill pipe 703 by the draw work of the rig, the arms of the spinner 700 are opened slightly to allow the spinner 700 to be lowered until the guiding bars 711, 712 overlap the lower drill pipe 704. Thereafter, the arms are closed using a reduced clamping force. Then, the upper drill pipe 703 is pulled out without contact of the flanks or crest of the threaded members.

In another embodiment, the rollers may engage the upper drill pipe without the guide bars overlapping a portion of the lower drill pipe. Thereafter, the upper drill pipe is lowered toward the upper drill pipe. In this respect, the guide bars will be positioned around the lower drill pipe to guide the upper drill pipe into engagement with the lower drill pipe. In another aspect, the inside surface of the lower portion of the guide bars may be beveled or angled to facilitate the lowering of the guide bars over the lower drill pipe.

One of the advantages of the stabbing guide 710 is that it may reduce damage to the threads during the make up or break out process. For example, some oil field threaded connections such as wedge threads require the threaded members to be guide during the connection process. With out guiding, the flanks of the threads may contact during pulling, thereby damaging the threads or prevent disconnection. By using the stabbing guide, contact between the flanks and/or the crest of the threaded members is minimized.

While the foregoing is directed to embodiments of the present invention, other and further embodiments of the invention may be devised without departing from the basic scope thereof, and the scope thereof is determined by the claims that follow.

We claim:

1. An apparatus for rotating a tubular, comprising:

a first arm having a first roller, wherein the first arm is adjustable to retain the tubular;

a second arm having a second roller, wherein the second arm is adjustable to retain the tubular;

a third roller capable of urging the tubular against the first and second rollers, wherein at least one of the first roller and the second roller is movable independently of the third roller toward and away from the tubular, and wherein at least one of the first, second, and third rollers is actuatable to rotate the tubular;

a cylinder for moving the third roller relative to at least one of the first and second rollers; and a cam surface on the first arm and the second arm, wherein the cam surface moves against a movable rod and is adapted to move the first arm and the second arm inwardly as the arms are retracted.

2. The apparatus of claim 1, wherein adjusting the first arm and the second arm comprises extending or retracting at least one of the first arm and the second arm.

3. The apparatus of claim 1, wherein the first arm and the second arm are coupled together.

4. The apparatus of claim 1, wherein adjusting at least one of the first arm and the second arm moves the tubular into contact with the third roller.

5. The apparatus of claim 1, wherein the first arm and the second arm are hingedly connected to a guide key.

6. The apparatus of claim 5, wherein the guide key moves in a guide slot.

7. The apparatus of claim 1, wherein the rollers establish a three point contact with the tubular.

8. The apparatus of claim 1, further comprising a tong assembly having:

a first gripping member operatively coupled to a second gripping member to retain the tubular;

the first gripping member including a first jaw; and the second gripping member including a second jaw, wherein at least one of the jaws is actuatable to apply a force to the tubular.

9. The apparatus of claim 1, further comprising a guide member coupled to at least one of the first arm and the second arm, wherein adjusting at least one of the first arm and the second arm also adjusts the guide member such that the guide member contacts a second tubular, whereby the guide member guides the first tubular into engagement with the second tubular.

10. The apparatus of claim 9, wherein the guide member comprises a guide bar.

11. The apparatus of claim 9, wherein a contact surface of the guide member is flush with a contact surface of at least one of the first roller and the second roller.

12. The apparatus of claim 9, further comprising a biasing member adapted to reduce a contact force between the guide member and the second tubular.

13. The apparatus of claim 1, wherein at least one of the first roller and second roller has a motor for imparting rotation.

14. The apparatus of claim 1, wherein the third roller is mounted on a third arm.

15. The apparatus of claim 14, wherein the third arm comprises a fluid cylinder.

16. The apparatus of claim 15, wherein the third arm comprises a spring biasing the third roller away from the tubular.

17. The apparatus of claim 1, further comprising a second cylinder for adjusting at least one of the first arm and the second arm.

18. An apparatus for rotating a tubular, comprising:

a first arm having a first roller;

a second arm having a second roller, at least one of the first arm and the second arm is adjustable to retain the tubular;

a third roller capable of urging the tubular against the first and second rollers, wherein at least one of the first, second, and third rollers is actuatable to rotate the tubular; and a cam surface on the first arm and the second arm, wherein the cam surface is adapted to move the first arm and the second arm inwardly as the arms are retracted, and wherein the cam surface moves against a movable rod.

19. An apparatus for rotating a tubular, comprising:

a first arm having a first roller;

a second arm having a second roller, at least one of the first arm and the second arm is adjustable to retain the tubular;

a third roller capable of urging the tubular against the first and second rollers, wherein at least one of the first, second, and third rollers is actuatable to rotate the tubular;

a guide member disposed coupled to at least one of the first arm and the second arm, wherein adjusting at least one of the first arm and the second arm also adjusts the guide member such that the guide member contacts a second tubular, whereby the guide member can guide the first tubular into engagement with the second tubular; and a biasing member adapted to reduce a contact force between the guide member and the second tubular.

20. An apparatus for rotating a tubular, comprising:

a first arm having a first roller, wherein the first arm is adjustable to retain the tubular;

a second arm having a second roller, wherein the second arm is adjustable to retain the tubular;

a third roller capable of urging the tubular against the first and second rollers, wherein at least one of the first roller and the second roller is movable independently of the third roller toward and away from the tubular, and wherein at least one of the first, second, and third rollers is actuatable to rotate the tubular;

a cylinder for moving the third roller relative to at least one of the first and second rollers; and a guide member coupled to at least one of the first arm and the second arm, wherein adjusting at least one of the first arm and the second arm also adjusts the guide member such that the guide member contacts a second tubular, whereby the guide member guides the first tubular into engagement with the second tubular.

21. The apparatus of claim 20, wherein the guide member comprises a guide bar.

22. The apparatus of claim 20, wherein a contact surface of the guide member is flush with a contact surface of at least one of the first roller and the second roller.

23. The apparatus of claim 20, further comprising a biasing member adapted to reduce a contact force between the guide member and the second tubular.

* * * * *